US009688923B2

(12) United States Patent
Yusuf et al.

(10) Patent No.: US 9,688,923 B2
(45) Date of Patent: Jun. 27, 2017

(54) INTEGRATED METHODS FOR SEPARATION AND EXTRACTION OF POLYNUCLEAR AROMATIC HYDROCARBONS, HETEROCYCLIC COMPOUNDS, AND ORGANOMETALLIC COMPOUNDS FROM HYDROCARBON FEEDSTOCKS

(71) Applicant: Saudi Arabian Oil Company, Dhahran (SA)

(72) Inventors: Zaki Yusuf, Dhahran (SA); Alberto Lozano Ballesteros, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 247 days.

(21) Appl. No.: 14/300,709

(22) Filed: Jun. 10, 2014

(65) Prior Publication Data

US 2015/0353847 A1 Dec. 10, 2015

(51) Int. Cl.
*C10G 21/08* (2006.01)
*C10G 21/00* (2006.01)
(Continued)

(52) U.S. Cl.
CPC ..... *C10G 53/06* (2013.01); *C10G 21/00* (2013.01); *C10G 21/08* (2013.01); *C10G 21/16* (2013.01); *C10G 21/20* (2013.01)

(58) Field of Classification Search
CPC ..... C10G 53/06; C10G 21/16; C10G 21/20; C10G 21/22
See application file for complete search history.

(56) References Cited

U.S. PATENT DOCUMENTS 2,541,458 A 2/1951 Berg
3,231,487 A 1/1966 Nettles
(Continued)

FOREIGN PATENT DOCUMENTS

CA 949910 A 6/1974
CA 1023677 A 1/1978
(Continued)

OTHER PUBLICATIONS

Hughley, C., et al., Elemental Composition of Processed and Unprocessed Diesel Fuel by Electrospray Ionization Fourier Transform Ion Cyclon Resonance Mass Spectrometry, 2001, Energy & Fuels, vol. 15, pp. 1186-1193.*
(Continued)

*Primary Examiner* — Renee Robinson
*Assistant Examiner* — Derek Mueller
(74) *Attorney, Agent, or Firm* — Dinsmore & Shohl LLP

(57) ABSTRACT

Methods are provided for extracting heterocyclic compounds, organometallic compounds, and polynuclear aromatic hydrocarbons from a hydrocarbon feedstock such as crude oil or a crude fraction. The heterocyclic compounds and organometallic compounds are removed from the hydrocarbon feedstock through one or more successive extractions to form a first raffinate. The extractions use a first solvent system containing an ionic liquid formed from carbon dioxide and water. The polynuclear aromatic hydrocarbons are removed from the first raffinate using a second solvent system containing an aprotic solvent such as NMP, DMSO, aromatics, or combinations thereof. The extracted compounds remain chemically intact and may be fractionated for further applications. Further methods are provided for producing a hydrocarbon raffinate having reduced levels of heterocyclic compounds, organometallic compounds, and 2-4 cycle polynuclear aromatic hydrocarbons.

17 Claims, 6 Drawing Sheets

(51) Int. Cl.

| | |
|---|---|
| ***C10G 53/06*** | (2006.01) |
| ***C10G 21/16*** | (2006.01) |
| ***C10G 21/20*** | (2006.01) |

(56) References Cited

U.S. PATENT DOCUMENTS

| | | | | |
|---|---|---|---|---|
| 3,546,098 | A * | 12/1970 | Spars | C10G 67/0445 208/18 |
| 3,649,500 | A | 3/1972 | Watson et al. | |
| 3,969,196 | A | 7/1976 | Zosel | |
| 4,098,692 | A | 7/1978 | Baker | |
| 4,746,420 | A | 5/1988 | Darian et al. | |
| 4,778,591 | A | 10/1988 | Reynolds | |
| 4,964,995 | A | 10/1990 | Chum et al. | |
| 5,120,900 | A | 6/1992 | Chen et al. | |
| 5,143,594 | A | 9/1992 | Stephenson et al. | |
| 5,329,045 | A | 7/1994 | Dedieu et al. | |
| 6,183,521 | B1 | 2/2001 | Lin et al. | |
| 6,187,175 | B1 | 2/2001 | Blum et al. | |
| 6,248,797 | B1 | 6/2001 | Dias et al. | |
| 6,566,410 | B1 | 5/2003 | Zaki et al. | |
| 7,622,035 | B2 | 11/2009 | Zaki et al. | |
| 8,257,579 | B2 | 9/2012 | Barrero et al. | |
| 8,431,358 | B2 | 4/2013 | Sadowski et al. | |
| 8,574,426 | B2 | 11/2013 | Mezza et al. | |
| 2004/0065353 | A1 | 4/2004 | Tunnicliffe et al. | |
| 2011/0049016 | A1 | 3/2011 | McGrady et al. | |
| 2011/0098507 | A1 | 4/2011 | Cohrs et al. | |
| 2012/0279902 | A1 | 11/2012 | McGrady et al. | |

FOREIGN PATENT DOCUMENTS

| | | | |
|---|---|---|---|
| CN | 87105863 | A | 3/1988 |
| CN | 103214332 | A | 7/2013 |
| DE | 10 2007 060 651 | B3 | 6/2009 |
| EP | 0 922 746 | A2 | 6/1999 |
| EP | 1177269 | | 2/2002 |
| EP | 2164930 | A1 | 3/2010 |
| EP | 2 338 955 | A1 | 6/2011 |
| EP | 2542651 | A1 | 1/2013 |
| EP | 2571961 | A2 | 3/2013 |
| WO | 0056842 | A1 | 2/2000 |
| WO | 00/76617 | A1 | 12/2000 |
| WO | 02066137 | A1 | 8/2002 |
| WO | 2008154576 | A1 | 12/2008 |
| WO | 2010148204 | A2 | 12/2010 |
| WO | 2011081601 | A1 | 7/2011 |
| WO | 2011106891 | A1 | 9/2011 |
| WO | 2011145086 | A2 | 11/2011 |
| WO | 2013089866 | A1 | 6/2013 |
| WO | 2013121219 | A1 | 8/2013 |

OTHER PUBLICATIONS

Notice of Allowance dated Jun. 30, 2015 pertaining to U.S. Appl. No. 14/143,711.

International Search Report and Written Opinion dated Mar. 16, 2015 pertaining to International Patent Application No. PCT/US2014/068048.

International Search Report and Written Opinion dated Mar. 18, 2015 pertaining to International Patent Application No. PCT/US2014/068047.

Nael N. Zaki, Ruben G. Carbonell, Peter K. Kilpatrick; A Novel Process for Demulsification of Water-in-Crude Oil Emulsions by Dense Carbon Dioxide; Ind. Eng. Chem. Res. 2003, 42, pp. 6661-6672.

Xiaoli Yang, Vincent J. Verruto, Peter K. Kilpatrick; Dynamic Asphaltene-Resin Exchange at the Oil/Water Interface: Time-Dependent W/O Emulsion Stability for Asphaltene/Resin Model Oils; Energy & Fuels 2007, 21, pp. 1343-1349.

Xuemei Chu, Yufeng Hu, Jiguang Li, Qianqing Liang; Yansheng Liu, Xianming Zhang, Xiaoming Peng, Wenjia Yue; Desulfurization of Diesel Fuel by Extraction with [BF4]-based Ionic Liquids; Chinese Journal of Chemical Engineering, 16(6); 2008; pp. 881-884.

Jian-Long Wang, Di-Shun Zhao, Er-Peng Zhou, Zhi Dong; Desulfurization of gasoline by extraction with N-alkyl-pyridinium-based ionic liquids; Journal of Fuel Chemistry and Technology; vol. 35; Issue 3; Jun. 2007; pp. 293-296.

Luisa Alonso, Alberto Arce, Maria Francisco, Ana Soto; Solvent extraction of thiophen from n-alkanes (C7, C12, and C16) using the ionic liquid [C8mim][BF4]; ScienceDirect The Journal of Chemical Thermodynamics 40; 2008; pp. 966-972.

Borja Rodriquez-Cabo, Maria Francisco, Ana Soto, Alberto Arce; Hexyl dimethylpyridinium ionic liquids for desulfurization of fuels. Effect of the position of the alkyl side chains; ScienceDirect Fluid Phase Equlibria 314; 2012, pp. 107-112.

Maria Francisco, Alberto Arce, Ana Soto; Ionic liquids on desulfurization of fuel oils; ScienceDirect Fluid Phase Equilibria 294; 2010; pp. 39-48.

Cun Zhang, Feng Wang, Xiao-Yu Pan, Xiao-Qin Liu; Study of extraction-oxidation desulfurization of model oil by acidic ionic liquid; ScienceDirect Journal of Fuel Chemistry and Technology; vol. 39; Issue 9; Sep. 2011; pp. 689-693.

Fa-Tang Li, Cheng-Guang Kou; Zhi-Min Sun; Ying-Juan Hao; Rui-Hong Liu; Di-Shun Zhao; Deep extractive and oxidative desulfurization of dibenzothiophene with C5H9NO.SnCl2 coordinated ionic liquid; SciVerse ScienceDirect Journal of Hazardous Materials 205-206; 2012; pp. 164-170.

Josef Planeta, Pavel Karasek, Michal Roth; Distribution of sulfur-containing aromatics between [hmim] [Tf2N] and supercritical CO2: a case study for deep desulfurization of oil refinery streams by extraction with ionic liquids; Green Chemistry; 2006; 8; pp. 70-77.

Jie Liu, Xuewen Sun, Dongbao Fu, Suoqi Zhao; Phase equilibria for separation of high boiling point organics from ionic liquids by supercritical CO2 or C3H8; Chemical Engineering Journal 147; 2009; pp. 63-70.

Norihito Hiyoshi, Yuka Murakami, Aritomo Yamaguchi, Osamu Sato, Chandrashekhar V. Rode, Masayuki Shirai; Purification of hydrocarbons from aromatic sulfur compounds by supercritical carbon dioxide extraction; The Journal of Supercritical Fluids 55; 2010; pp. 122-127.

International Search Report and Written Opinion dated Aug. 6, 2015 pertaining to International Application No. PCT/US2015/031327.

Office Action dated Nov. 12, 2015 pertaining to U.S. Appl. No. 14/617,358.

Bauserman, Joy W. et al.; Organic Nitrogen Compounds and Fuel Instability in Middle Distillate Fuels; Ind. Eng. Chem. Res.; 2008; pp. 2867-2875; vol. 47; American Chemical Society.

Notice of Allowance dated Oct. 8, 2014 pertaining to U.S. Appl. No. 14/107,471.

Notice of Allowance dated Mar. 29, 2016 pertaining to U.S. Appl. No. 14/617,358.

* cited by examiner

INTEGRATED METHODS FOR SEPARATION AND EXTRACTION OF POLYNUCLEAR AROMATIC HYDROCARBONS, HETEROCYCLIC COMPOUNDS, AND ORGANOMETALLIC COMPOUNDS FROM HYDROCARBON FEEDSTOCKS

BACKGROUND

Field

The present specification generally relates to petroleum processing and, more specifically, to integrated systems and methods for separating, extracting, and recovering polynuclear aromatic hydrocarbons, heterocyclic compounds, and organometallic compounds from a hydrocarbon feedstock.

Technical Background

Crude oil or petroleum refineries are integrations of complex processes in which crude oil and its fractions are processed by various unit operations and unit processes. A conventional refinery primarily produces transportation fuels such as liquefied petroleum gas (LPG), diesel, gasoline, aviation fuel, kerosene, and fuel oils, for example. Some refineries may also produce bitumen, asphaltenes, and aromatics. Still other petroleum refineries produce lube oils, anode grade coke, and BTX (benzene, toluene, xylene) products, depending on the type of crude they are processing. New generation refineries also produce olefins as petrochemical feedstock in addition to BTX products.

However, the major products that come from refineries are the transportation fuels. With newer and stricter legislations on $SO_x$, $NO_x$ and particulate emissions the hydrotreatment requirement of the transportation feedstock is becoming more challenging for the refiners. Refineries consume a significant amount of energy (7-15%) during processing of crude oil and more specifically while hydrotreating the transportation fuels.

Refiners are processing heavier crude (lower API gravity) as the supply of light crude is dwindles. To improve the yield of transportation fuel, e.g., the light and mid-distillate, the refiners are cracking the higher boiling point resin fractions of heavy and medium crude. Moreover, the heavy distillates (cracked or vacuum) and deasphalted oil (DAO) contain very high quantities of heterocyclics and polynuclear aromatic hydrocarbons (PAHs) and as a result, significant quantities of heterocyclics and PAHs end up in the cracked heavy and mid distillates, whereas the low molecular weight aromatics and heterocyclics end up in light cracked distillates.

The increased presence of heterocyclic compounds and PAHs in the crude supply is placing increasingly stronger constraints on hydrotreatment of the cracked distillates coming from the heavy fractions. For example, Arab Heavy contains 2.78 wt. % sulfur in virgin crude, whereas Arab Medium contains 1.4 wt. % sulfur in its crude (on elemental S basis). On average, a minimum of 5-10 wt. % (as organic S compounds) of hydrocarbon is chemically bound with sulfur (S) and nitrogen (N) heterocyclics in heavy and medium crude oil in addition to PAHs, mostly in the resins and asphaltenes. Moreover, owing to higher boiling point of resins and asphaltenes, the heterocyclic and organometallic compounds and PAHs end up in the heavy fractions after the fractionation in the Atmospheric and Vacuum distillation column. Because the PAHs, organometallic, and heterocyclic compounds are chemically bound in the larger macromolecules such as resins and asphaltenes, the direct recovery or extraction of these larger macromolecules is not convenient or profitable and commercially attractive from the atmospheric or vacuum resin fractions. Macromolecules (from resins) must be further cracked so that only the smaller PAHs and heterocyclic and organometallic compounds with minimal side chains can be separated once again before commercially marketing them as feedstocks for fine chemicals as smaller fragmented molecules.

To obtain increased quantities of mid-distillate, the heavier fractions (atmospheric bottoms and vacuum residue) of crude are cracked depending on the refinery configuration and type of crude. As a result, the heterocyclics and PAHs from resins and, to some extent, from asphaltenes end up as smaller fragmented molecules after the cracking. A significant number of heterocyclic and PAH fractions (10 wt. % or more, as organic compound basis) remain in the mid-distillates, heavy distillates and, to some extent, the light distillate after this cracking. Therefore, concentrations of the organic heterocyclic compounds, organometallic compounds, and 2-4 cycle PAH compounds are significantly increased in mid and heavy distillate fractions. The light and mid distillates from the refining operation are sent for hydrotreatment (HDT) to remove the compounds to produce transportation fuels (gasoline and diesel) lower in sulfur, nitrogen, and metals. But during the conventional hydrotreatment (HDT) of crude fractions, e.g., especially mid-distillate (diesel pool) and light distillate (gasoline pool), the heterocyclic compounds are converted to hydrocarbon molecules, free from sulfur and nitrogen, whereas the PAHs are converted to aromatics and/or saturated cyclics.

Notwithstanding their troublesome nature when left in petroleum products such as transportation fuels, for example, the PAHs and organic heteroatom compounds possess exotic properties. In particular, they are optically active, electrically active, chemically active, and have interesting semiconducting properties and radio-frequency properties. They also have high value in several technical markets. The same compounds lose their exotic properties during conventional hydrotreatment processes in refineries due to the saturation of their conjugated bonds.

Polynuclear aromatic hydrocarbons, refractory heterocyclic organic compounds containing sulfur and/or nitrogen, and organometallic compounds are valuable chemical feedstocks for many applications. Such compounds find uses in production of fine chemicals or as building blocks for organic solar cells, organic LEDs, other organic thin-film transistors, ultra-high performance batteries, for example. Various derivatives of such compounds are also finding their places in research environments for industries such as consumer electronics and renewable energy. Though most or all of these compounds are found naturally in hydrocarbon feedstocks such as crude oil, crude fractions, and petroleum sources, for example, conventional methods of petroleum production or refining typically either cause the compounds to go to waste, to be left as minor impurities in other products without capitalizing on the additional value of the compounds in isolation, or to be removed from the petroleum source but chemically converted to sulfur, nitrogen and metal free organic hydrocarbon during the removal.

As the overall crude oil supply around the world is diminishing, the existing crude oil supply is becoming heavier all across the globe. The presence of PAHs, the refractory heterocyclic organic compounds, and the organometallic compounds is much greater in heavy crude oil than in lighter crude oil. In turn, conventional hydrodesulfurization/hydrodenitrogenation (HDS/HDN) processes or demetallization processes typically used to remove such compounds from crude petroleum are being strained, especially in terms of increased cost. The cost of HDS/HDN rises with respect to the amount of the compounds in the crude oil, because HDS/HDN or demetallization requires higher severity and higher hydrogen consumption to remove greater amounts of the compounds.

On the other hand, if PAHs, refractory heterocyclic organic compounds, and organometallic compounds can be removed from crude oil or crude fractions at lower severity and without destroying their molecular structures, two benefits can be realized. First, the compounds may be provided for further applications. Second, the total cost of HDN/HDS to eliminate nitrogen and sulfur from the crude fractions can be drastically reduced. Accordingly, ongoing needs exist for systems and methods that remove PAHs, refractory heterocyclic organic compounds containing sulfur and/or nitrogen, and organometallic compounds from crude oil or crude fractions without destroying the molecular structures thereof so that the compounds may be used or kept available for other applications.

SUMMARY

According to various embodiments, methods are described for producing a hydrocarbon raffinate having reduced levels of heterocyclic compounds, organometallic compounds, and polynuclear aromatic hydrocarbons. The heterocyclic compounds, organometallic compounds, and polynuclear aromatic hydrocarbons may be referred to herein collectively as "heteroatom compounds." The methods may include providing a hydrocarbon feedstock containing crude oil fractions with a boiling point range of from about 165° C. to about 430° C. The crude oil fractions may contain heterocyclic compounds, organometallic compounds, and polynuclear aromatic hydrocarbons. The heterocyclic compounds, the organometallic compounds, or both are extracted from the hydrocarbon feedstock in a heteroatom extraction system with a tunable solvent to form a heteroatom-compound rich stream containing the heterocyclic compounds, the organometallic compounds, or both, and a heteroatom-compound lean stream containing the polynuclear aromatic hydrocarbons. The tunable solvent contains an ionic liquid formed from pressurized carbon dioxide and water. Subsequently, the polynuclear aromatic hydrocarbons may be extracted from the heteroatom-compound lean stream with a solvent system to form the hydrocarbon raffinate. The solvent system contains an aprotic solvent.

According to further embodiments, methods are described for extracting heteroatom compounds and polynuclear aromatic hydrocarbons from a hydrocarbon feedstock containing the heteroatom compounds and the polynuclear aromatic hydrocarbons. The methods may include extracting at least one targeted portion of the heteroatom compounds from the hydrocarbon feedstock and transferring to a PAH extractor a heteroatom-lean stream containing the polynuclear aromatic hydrocarbons after all targeted portions of the heteroatom compounds have been extracted from the hydrocarbon feedstock. The polynuclear aromatic hydrocarbons may be extracted from the heteroatom-lean stream in the PAH extractor with a solvent system comprising an aprotic solvent. Extracting each targeted portion of the heteroatom compounds from the hydrocarbon feedstock may include feeding into an extraction vessel the hydrocarbon feedstock or a feed stream derived from the hydrocarbon feedstock. An aqueous solvent comprising an ionic liquid formed from pressurized carbon dioxide and water may be fed into the extraction vessel, such that the combination of the hydrocarbon feedstock or the feed stream with the aqueous solvent forms an extraction mixture. Alternatively, the aqueous solvent and the hydrocarbon feedstock may be premixed to form the extraction mixture, and the extraction mixture may be fed into the extraction vessel. The aqueous solvent may be tuned in the extraction vessel to selectively form solvent complexes with the targeted portion of the heteroatom compounds in the extraction mixture, whereby the extraction mixture separates into at least a heteroatom-compound rich phase and a heteroatom-compound lean phase, the heteroatom-compound rich phase containing the solvent complexes. The heteroatom-compound lean phase may be removed from the extraction vessel as a heteroatom-compound lean stream. The heteroatom-compound rich phase may be removed from the extraction vessel as a heteroatom-compound rich stream. Optionally, the heteroatom-compound lean stream may be transferred from the extraction vessel as a feed stream derived from the hydrocarbon feedstock to an additional extraction vessel for extraction of an additional targeted portion of heteroatom compounds from the feed stream.

Additional features and advantages of the embodiments described herein will be set forth in the detailed description which follows, and in part will be readily apparent to those skilled in the art from that description or recognized by practicing the embodiments described herein, including the detailed description which follows, the claims, as well as the appended drawings.

It is to be understood that both the foregoing general description and the following detailed description describe various embodiments and are intended to provide an overview or framework for understanding the nature and character of the claimed subject matter. The accompanying drawings are included to provide a further understanding of the various embodiments, and are incorporated into and constitute a part of this specification. The drawings illustrate the various embodiments described herein, and together with the description serve to explain the principles and operations of the claimed subject matter.

DETAILED DESCRIPTION

Figure 1:
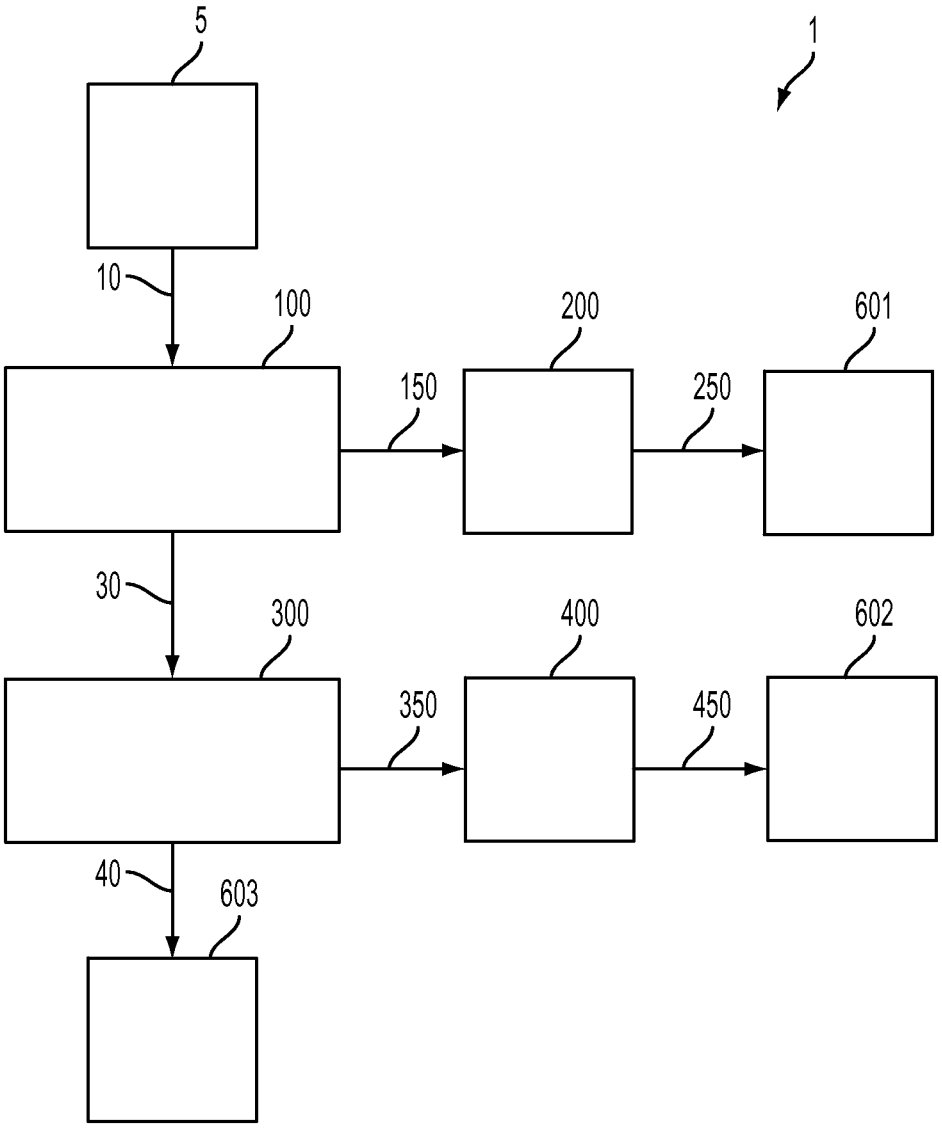
FIG. 1 is a schematic diagram of an extraction system that may be used in embodiments of methods for separating or extracting organic heteroatom compounds and polynuclear aromatic hydrocarbons from a hydrocarbon feedstock described herein.

Embodiments of methods for producing a hydrocarbon raffinate having reduced levels of heterocyclic compounds, organometallic compounds, and polynuclear aromatic hydrocarbons will be described. Embodiments of methods for separating or extracting organic heteroatom compounds and polynuclear aromatic hydrocarbons from a hydrocarbon feedstock containing the organic heteroatom compounds and the polynuclear aromatic hydrocarbons also will be described. The methods of separating or extracting organic heteroatom compounds and polynuclear aromatic hydrocarbons from a hydrocarbon feedstock and the methods for producing the hydrocarbon raffinate each may include removing the heteroatom compounds from the hydrocarbon feedstock by extraction in a tunable solvent, followed by removing the polynuclear aromatic hydrocarbons in a solvent system including an aprotic solvent.

As used herein, the term "polynuclear aromatic hydrocarbon" or "PAH" refers to a hydrocarbon compound having multiple aromatic rings, in which at least two of the multiple aromatic rings are fused, i.e., share at least one side such that at least two carbon atoms are common to two aromatic rings. Polynuclear aromatic hydrocarbons are a subset of "polycyclic aromatic hydrocarbons," which are also hydrocarbons having multiple aromatic rings, but in which fusion of aromatic rings is not necessarily present. Naphthalene is the simplest example of a polynuclear aromatic hydrocarbon. In naphthalene, two carbon atoms are shared between two fused benzene rings. In contrast, biphenyl is a polycyclic aromatic hydrocarbon because it has two aromatic rings, but biphenyl is not a polynuclear aromatic hydrocarbon because the two aromatic rings are not fused. In general, polynuclear aromatic hydrocarbons described herein are molecules formed strictly of carbon and hydrogen, which do not contain any heteroatoms (i.e., atoms other than carbon or hydrogen), and which do not carry substituents on any carbon atoms of the aromatic rings.

As used herein, the term "x-y cycle PAH," in which x and y are integers, refers to a polynuclear aromatic hydrocarbon, as defined above, having from x to y aromatic rings, inclusive of x and y, at least two of which aromatic rings are fused to each other. For example, the term "2-4 cycle PAH" describes a polynuclear aromatic hydrocarbon, as defined above, having exactly 3 aromatic rings, exactly 3 aromatic rings, or exactly 4 aromatic rings, at least two of which aromatic rings are fused to each other.

As used herein interchangeably, the terms "heterocyclic compound" and "organic heterocyclic compound" refer to a cyclic organic compound having at least one ring that contains at least one carbon atom and at least one atom of an element other than carbon, such as sulfur, nitrogen, or oxygen, for example. Heterocyclic compounds may consist of a single ring containing at least one carbon atom and at least one atom of an element other than carbon or may comprise multiple rings, of which some or all of the multiple rings contain at least one carbon atom and at least one atom of an element other than carbon. In some embodiments, heterocyclic compounds include from 1 to 4 rings or from 2 to 4 rings, at least one of which includes nitrogen, sulfur, or both. In other embodiments, heterocyclic compounds include 3 or more rings, such as 3 or 4 rings, at least one of which includes nitrogen, sulfur, or both.

As used herein, the term "organometallic compound" refers to an organic compound containing at least one metal atom. The at least one metal atom may be bonded directly to a carbon atom or may be a metal center of a coordination compound between the at least one metal atom and at least one organic ligand.

As used herein interchangeably, the terms "heteroatom compound," "organic heteroatom compound," and "HC" refer collectively to heterocyclic compounds and organometallic compounds, as defined above. Non-limiting examples of heteroatom compounds include organosulfur compounds such as sulfur-containing heterocyclic compounds, organonitrogen compounds such as nitrogen-containing heterocyclic compounds, and organometallic compounds such as porphyrins. In some embodiments, heteroatom compounds may be natural impurities found in a hydrocarbon feedstock such as crude oil or a crude oil fraction, for example.

Light and mid-distillate crude fractions (those having boiling points from about 165° C. to about 430° C.) include mixtures of hydrocarbons that are processed into critical products such as gasoline and diesel fuel, for example. The mixtures of hydrocarbons also typically include contaminants in the form of heteroatom compounds and PAHs. These contaminants, which typically include sulfur compounds, nitrogen compounds, heavy metal compounds, or combinations of these, become environmental nuisances if left in the refined products. Hydrotreatment and desulfurization processes are examples of conventional methods by which the contaminants are removed from the refined products. Both processes involve heat and use of pressurized hydrogen, and are therefore energy intensive.

In conventional refining, polynuclear aromatic hydrocarbons and heterocyclic compounds in the light and mid-distillate fractions are not extracted or separated prior to hydrotreatment or desulfurization. In general, the larger the polynuclear aromatic hydrocarbons and heterocyclic compounds are, the more energy-intensive their removal by hydrotreatment or desulfurization can be. For example, the kinetics of removing heterocyclic compounds from a hydrocarbon feedstock by hydrotreatment are at least an order of magnitude slower when the heterocyclic compound has three or four rings, compared with when the heterocyclic compound has only two rings. The difference in kinetics is related in part to the number of chemical bonds that must be broken in the heterocyclic compounds to liberate the sulfur atom. The amount and pressure of hydrogen gas to be used in hydrotreatment or desulfurization, as well as the overall temperature of hydrotreatment or desulfurization, all follow the same trend. Regardless, hydrotreatment or desulfurization processes in conventional refining simply remove the contaminant molecules and reduce them to unusable forms such as to hydrogen sulfide or elemental sulfur.

Recovery of heteroatom compounds from crude fractions is not an established process or one found integrated into modern refining operations. In some instances, "designer" ionic liquids have been customized for extractions and used to target specific organics present in the crude factions. However, designer ionic liquids and conventional and room temperature ionic liquids all are generally exorbitantly expensive, are prone to cross contamination, and are believed to have adverse environmental implications. Traditional ionic liquids have mass-transfer limitations due to very high viscosity, and there remains a possibility of crude fraction cross-contamination. The purification of heterocyclic compounds and organometallic compounds by distillation processes are challenging, because these compounds have high boiling points, at which ionic liquids tend to be unstable or subject to decomposition. Therefore, cost, mass transfer limitation, purification, stability, environmental factors are bottlenecks for extraction of these compounds from crude and its fractions.

According to some embodiments of the methods described herein, at least a portion of the heteroatom compounds present in a hydrocarbon feedstock are removed from the hydrocarbon feedstock using a first solvent system to form a heteroatom-rich stream and a heteroatom-lean stream. When extraction and further use of the heteroatom compounds are desired, the heteroatom-rich stream may be further processed to provide outputs of individual heteroatom compounds. The heteroatom-lean stream may be treated in a second solvent system to remove mixtures of polynuclear aromatic hydrocarbons, which mixtures may be further processed to provide outputs of individual polynuclear aromatic hydrocarbons if desired. After removal of the polynuclear aromatic hydrocarbons from the heteroatom-lean stream, a hydrocarbon raffinate that is lean in both heteratom compounds and polynuclear aromatic hydrocarbons is formed. The hydrocarbon raffinate may be subjected to desulfurization or hydrotreatment processes having substantially reduced energy costs compared to conventional processes in which the hydrocarbon feedstock would be subjected to the desulfurization or hydrotreatment processes without removal of the heteroatom compounds and/or the polynuclear aromatic hydrocarbons.

Embodiments of methods for producing a hydrocarbon raffinate having reduced levels of heteroatom compounds and polynuclear aromatic hydrocarbons will now be described. The hydrocarbon raffinate formed according to embodiments of the methods may itself have particular value in a refinery setting, for example, because treatment of the hydrocarbon raffinate by hydroprocessing or desulfurization will require substantially less energy than an identical treatment performed on a hydrocarbon feedstock. The methods for producing the hydrocarbon raffinate may include providing a hydrocarbon feedstock containing crude oil fractions with a boiling point range of from about 165° C. to about 430° C. The crude oil fractions may include heteroatom compounds and polynuclear aromatic hydrocarbons. In some embodiments, the crude oil fractions may include heteroatom compounds and polynuclear aromatic hydrocarbons. In come embodiments, the polynuclear aromatic hydrocarbons may be 1-4 cycle PAHs, 2-4 cycle PAHs, or 3-4 cycle PAHs, for example.

The methods for producing the hydrocarbon raffinate may further include extracting at least a portion of the heteroatom compounds from the hydrocarbon feedstock with a tunable solvent in at least one extraction vessel of a heteroatom extraction system. The heteroatom extraction system will be described in greater detail below. The extraction may form a heteroatom-compound rich stream containing heteroatom compounds and a heteroatom-compound lean stream containing the polynuclear aromatic hydrocarbons. The tunable solvent may include an ionic liquid formed from pressurized carbon dioxide and water. The tunable solvent also will be described in greater detail below. The heteroatom-compound lean stream may be transferred to another vessel, and then the polynuclear aromatic hydrocarbons may be extracted from the heteroatom-compound lean stream. The polynuclear aromatic hydrocarbons may be extracted with a solvent system that contains an aprotic solvent and, optionally, a protic solvent. Exemplary aprotic solvents include N-methylpyrrolidone, dimethylsulfoxide, and aromatic compounds, for example. Exemplary protic solvents include water and acetic acid, for example. Once the polynuclear aromatic hydrocarbons are removed from the heteroatom-compound lean stream, the resulting hydrocarbon raffinate has substantially lower amounts of heteroatom compounds and polynuclear aromatic hydrocarbons than the original hydrocarbon feedstock. As such, the hydrocarbon raffinate formed according to embodiments herein will require substantially less cost and energy to treat by hydroprocessing or desulfurization.

According to some embodiments of methods for producing the hydrocarbon raffinate, extracting at least a portion of the heteroatom compounds from the hydrocarbon feedstock may include extracting from the hydrocarbon feedstock a first portion of the heteroatom compounds having a first polarity to form a first feed stream. The first portion of the heteroatom compounds may be extracted in a first extraction vessel of the heteroatom extraction system operating at a first pressure. The methods may further include extracting from the first feed stream a second portion of the heteroatom compounds having a second polarity lower than the first polarity to form a second feed stream. The second portion of the heteroatom compounds may be extracted in a second extraction vessel of the heteroatom extraction system operating at a second pressure higher than the first pressure after extracting the first portion of the heteroatom compounds. The methods may further include extracting from the second feed stream a third portion of the heteroatom compounds having a third polarity lower than the second polarity to form the heteroatom-compound lean stream. The third portion of the heteroatom compounds may be extracted in a third extraction vessel of the heteroatom extraction system operating at a third pressure greater than the first pressure and the second pressure after extracting the second portion of the heteroatom compounds.

According to some embodiments of methods for producing the hydrocarbon raffinate, at least 80%, at least 90%, at least 95%, at least 99%, at least 99.5%, at least 99.9%, or even 100% of the heteroatom compounds by weight from the hydrocarbon feedstock are extracted into the heteroatom-compound rich stream, either in a single extraction step or after a combination of multiple extraction steps that each removes heteroatom compounds on the basis of polarity. In embodiments wherein at least 80%, at least 90%, at least 95%, at least 99%, at least 99.5%, at least 99.9%, or even 100% of the heteroatom compounds are removed in a single extraction step, the heteroatom-compound lean stream from the single extraction step may be subjected to PAH extraction. In embodiments involving multiple extraction steps to remove the heteroatom compounds, the PAH extraction may be conducted on the heteroatom-lean stream resulting from the last extraction step to remove the heteroatom compounds.

The methods for producing the hydrocarbon raffinate according to embodiments described above may be used for a limited purpose, such as to provide a raffinate that may be hydroprocessed at a lower cost than the hydrocarbon feedstock can be hydroprocessed. When used for such a limited purpose, the methods for producing the hydrocarbon raffinate according to embodiments described above need not include any components or considerations for separating, isolating, or preserving the integrity of the mixtures of heteroatom compounds and/or polynuclear aromatic hydrocarbons that are removed from the hydrocarbon feedstock. However, additional value can be realized from the methods for producing the hydrocarbon raffinate when the heteroatom compounds and/or the polynuclear aromatic hydrocarbons are not only removed from the hydrocarbon feedstock but are also extracted or isolated from the hydrocarbon feedstock for further uses or applications. With this additional value in mind, embodiments of methods for removing or extracting of heteroatom compounds and PAHs from crude fractions will now be described. Methods according to such embodiments may include isolations and separations of the heteroatom compounds and PAHs.

As in the embodiments of methods for producing the hydrocarbon raffinate described above, in methods for removing or extracting of heteroatom compounds and PAHs from crude fractions, a tunable and switchable smart solvent system is provided as an alternative to customary ionic liquids. As an added benefit to reducing the energy requirements of hydroprocessing, the extracted heteroatom compounds and PAHs may be recovered as feedstocks for fine chemicals, biochemicals, pharmaceuticals, materials for organic solar cells, materials for organic electronics, or materials for high-performance organic batteries. In conventional refining processes, these potentially useful molecules are effectively destroyed through conversion to $H_2S$ or elemental sulfur via a Claus process. In contrast, embodiments of methods described herein include selective extraction and purification or segregation of these heterocyclic compounds, organometallic compounds, and PAHs from specific crude fractions that may be used to produce useful chemical feedstocks from a petroleum refinery, for example.

In embodiments of methods for separating or extracting heteroatom compounds and polynuclear aromatic hydrocarbons from a hydrocarbon feedstock containing the heteroatom compounds and the polynuclear aromatic hydrocarbons, two separate solvent systems are used to capture or extract two separate classes of compounds, in particular, organic heteroatom compounds and polynuclear aromatic hydrocarbons. During a first stage of extraction, a switchable, tunable, solvent that behaves as an ionic liquid is deployed to recover sulfur heterocyclic compounds, nitrogen heterocyclic compounds, and organometallic compounds from crude and its fractions without cross contaminating the crude fractions. The crude fractions in the boiling point range of (165° C. to 430° C.) may be primarily rich in sulfur and nitrogen heterocyclic compounds and organometallic compounds. The fractions may be derived from cracked fractions (catalytic or non-catalytic) products from refining operations. In refineries, there may be different streams of cracked product coming from different units. The solvent of the first stage may include supercritical and subcritical carbon dioxide ($CO_2$) and water that form complexes with heterocyclic compounds and organometallic compounds. After the extraction stage, the recovered compounds are ejected from the solvent system in separate vessels by pressure and or temperature swing and are immobilized in a second solvent system including aprotic solvents such as NMP, DMSO, aromatic solvents, or combinations thereof. The first solvent system ($CO_2$ and water) may be recycled for further recovery of the heterocyclic compounds. Thereby, the heterocyclic compounds can be recovered without contaminating the crude fractions.

Following the first extraction, the heteroatom-compound fractions are again subjected to extraction using an aprotic solvent-system to extract PAHs, such as 2-4 cycle PAHs or 3-4 cycle PAHs, for example. A seamless integration of this separation processes with petroleum refinery results in smooth, continuous, and profitable operation of the refinery. The sequence of the deployments of the solvents for extraction units, first the tunable solvent, then the aprotic solvent, prevents the aprotic solvents from indiscriminately extracting the heterocyclics and PAHs as a mixed product.

The methods for separating or extracting organic heteroatom compounds and polynuclear aromatic hydrocarbons from a hydrocarbon feedstock containing the organic heteroatom compounds and the polynuclear aromatic hydrocarbons according to various embodiments may include feeding the hydrocarbon feedstock and an aqueous solvent into an extraction vessel to form an extraction mixture in the extraction vessel. The aqueous solvent may include an ionic liquid formed from pressurized carbon dioxide and water. In some embodiments, the hydrocarbon feedstock and the aqueous solvent may be fed separately into the extraction vessel, such that they are first mixed in the extraction vessel. In other embodiments, the hydrocarbon feedstock may be mixed to form the extraction mixture, and then the extraction mixture may be fed into the extraction vessel.

According to some embodiments, methods for producing the hydrocarbon raffinate, as well as the methods for separating or extracting organic heteroatom compounds and polynuclear aromatic hydrocarbons from a hydrocarbon feedstock, may be carried out using a system such as the extraction system 1 of FIG. 1, for example. It should be understood that the extraction system 1 of FIG. 1 is meant to be illustrative of only one non-limiting embodiment of a system that may be used in the methods described herein. It should be further understood that the extraction system 1 of FIG. 1 may be altered in numerous ways yet still remain capable of performing the methods described herein.

In the extraction system 1 according to FIG. 1, from a hydrocarbon source 5, a hydrocarbon feedstock 10 may be introduced into a heteroatom-compound extraction system 100. The hydrocarbon source 5 may be any location or conduit from which the hydrocarbon feedstock 10 can be introduced into the heteroatom-compound extraction system 100, such as a reservoir containing petroleum, crude oil, or a crude fraction, or from a separate system or operation present in a petroleum refinery, for example. In some embodiments, the hydrocarbon feedstock 10 may be crude oil, a crude fraction, or any hydrocarbon mixture containing one or more heteroatom compounds and one or more polynuclear aromatic hydrocarbons. In illustrative embodiments, the heteroatom compounds, the polynuclear aromatic hydrocarbons, or both, may have at least three rings in their respective chemical structures. For example, the polynuclear aromatic hydrocarbons may be 2-4 cycle PAHs or 3-4 cycle PAHs.

The heteroatom-compound extraction system 100 separates the hydrocarbon feedstock 10 into a heteroatom-compound recovery stream 150 and a heteroatom-compound lean stream 30. Additional intermediate steps of the separation of the hydrocarbon feedstock 10 into the heteroatom-compound recovery stream 150 and a heteroatom-compound lean stream 30 will be described below with reference to FIGS. 2-4. The heteroatom-compound recovery stream 150 may be transferred to a heteroatom-compound fractionator 200. The heteroatom-compound fractionator 200 separates the heteroatom-compound recovery stream 150 into multiple heteroatom-compound solute fractions 250. Each heteroatom-compound solute fraction 250 may be recovered at a heteroatom-compound recovery vessel 601 assigned to the heteroatom-compound solute fraction 250.

The heteroatom-compound lean stream 30 from the heteroatom-compound extraction system 100 according to FIG. 1 may be transferred to a PAH extraction system 300. The PAH extraction system 300 may contain a solvent system that separates the heteroatom-compound lean stream 30 into a PAH-rich phase and a PAH-lean phase. The PAH-lean phase may be transferred as a raffinate stream 40 to a raffinate recovery vessel 603 for additional processing. The PAH-rich phase may be transferred as a PAH recovery stream 350 to a PAH fractionator 400. The PAH fractionator 400 separates the PAH recovery stream 350 into multiple PAH solute fractions 450. Each PAH solute fraction 450 may be recovered at a PAH compound recovery vessel 602 assigned to the PAH solute fraction 450. It should be understood that the schematic of FIG. 1 is intended to be cursory in nature. Individual components of the extraction system 1, such as the heteroatom-compound extraction system 100, the heteroatom-compound fractionator 200, the PAH extraction system 300, and the PAH fractionator 400, each will be described in greater detail below.

In embodiments of methods for producing the hydrocarbon raffinate, as well as the methods for separating or extracting organic heteroatom compounds and PAHs from a hydrocarbon feedstock, the extraction system 1 of FIG. 1 includes a heteroatom-compound extraction system 100. The heteroatom-compound extraction system 100 removes at least a portion of the heteroatom compounds from the hydrocarbon feedstock through use of a reversible/switchable/tunable solvent system (hereinafter referred to as "tunable solvent"). The tunable solvent allows the heteroatom compounds to maintain their physical and chemical properties upon separation from the hydrocarbon feedstock. In some embodiments, the tunable solvent may be an ionic liquid, a gas expanded ionic liquid, or another solvent that selectively attracts the heteroatom compounds. The tunable solvent may form a reversible complex with the heteroatom compounds. In some embodiments, various properties of the tunable solvent can be controlled so that the tunable solvent becomes more ionic or less ionic in nature and, thus, may be selectively attracted to or selectively form reversible complexes with one or more chosen heteroatom compounds. The switchable or tunable solvents are also known as "reversible ionic liquids" and are highly compatible with crude fractions having boiling points in the range 165° C. to 430° C. The tunable solvent can act homogeneously or heterogeneously by appropriate tuning of the solvent properties such that it selectively dissolves or forms complexes with heteroatom compounds from the hydrocarbon phase.

In some embodiments the tunable solvent includes a mixture of water and supercritical or subcritical liquid carbon dioxide. In some embodiments, the aqueous solvent includes supercritical carbon dioxide. In some embodiments, the aqueous solvent includes subcritical carbon dioxide. In other embodiments, the aqueous solvent includes both supercritical and subcritical carbon dioxide. As noted above, in some embodiments the aqueous solvent may be mixed with the hydrocarbon feedstock to form an extraction mixture within an extraction vessel. Also as noted above, in other embodiments, the aqueous solvent may be mixed with the hydrocarbon feedstock to form an extraction mixture, and subsequently the extraction mixture may be fed into an extraction vessel. In some embodiments, subcritical or supercritical $CO_2$ may be used in combination with or without water as other solvent, and a solvent-modifier may also be introduced to improve selectivity of the tunable solvent toward certain classes of heteroatom compounds. When a solvent-modifier is used, the pressure of the tunable solvent may be shifted from the supercritical region toward the subcritical region in such a manner that the least polar solutes are ejected at the beginning of the pressure reduction, and subsequently the most polar compounds get ejected at later stages. The selectivity of the tunable solvents may be controlled during solute recovery, such that the heteroatom compounds may be separated or ejected from the solvent system in a series of vessels by controlling or reducing the pressure in the vessels.

The methods for producing the hydrocarbon raffinate, as well as the methods for separating or extracting organic heteroatom compounds and polynuclear aromatic hydrocarbons from a hydrocarbon feedstock according to various embodiments may include tuning the aqueous solvent to selectively form solvent complexes with at least a portion of the heterocyclic organic compounds and the organometallic compounds in the hydrocarbon feedstock, whereby the extraction mixture separates into at least a heteroatom-compound rich phase and a heteroatom-compound lean phase. The tuning of the aqueous solvent may be carried out in the extraction vessel or before the aqueous solvent enters the extraction vessel, and in either case before or after the aqueous solvent is mixed with the hydrocarbon feedstock. The heteroatom-compound rich phase contains substantially all of the solvent complexes, and the heteroatom-compound lean phase has a substantially higher concentration of polynuclear aromatic hydrocarbons than the heteroatom-compound rich phase. The tuning of the aqueous solvent will now be described.

Depending on the source from which they are derived, hydrocarbon feedstocks, and particularly hydrocarbon feedstocks derived from crude oil or crude oil fractions, can contain varying types and amounts of heteroatom compounds. By adjusting the solubility parameters of a particular organic heteroatom compound targeted for extraction, impurities in the hydrocarbon feedstock may be selectively separated from the hydrocarbon feedstocks using the tunable solvent. In an illustrative embodiment, solubility parameters of a particular organic heteroatom compound may be adjusted by exploiting the polarity of any target organic heteroatom compound. In some embodiments, the tunable solvent may be modified by adjusting the pressure, temperature, and/or pH of the solvent system so that the target organic heteroatom compound is maintained as a solute in the solvent system. Once the organic heteroatom compound is solvated, further adjustment of the pressure, temperature, and/or pH of the solvent system may reverse the solvation, whereby the heteroatom compound can be easily recovered as an aggregate, a precipitate, or the like.

During the separation process in an extraction vessel, supercritical carbon dioxide may promote the movement of heteroatom compounds from a primarily hydrocarbon phase and toward a primarily aqueous phase of the tunable solvent. Supercriticial $CO_2$ has low viscosity and sufficient diffusivity to allow it to penetrate the hydrocarbon phase and access the targeted heteroatom compounds. A reversible ionic liquid may be formed when $CO_2$ reacts with water to form carbonic acid. Dissociated carbonic acid is ionic in nature. The ions in the carbonic acid may form temporary complexes with the targeted heteroatom compounds, based on the conditions used to tune the tunable solvent. Heteroatom compounds exhibit some amount of polar behavior due to electronegativity differences between the sulfur-carbon bonds, nitrogen-carbon bonds or metal-carbon bonds present in the heteroatom compounds.

As a result of the polar properties of the heteroatom compounds, the heteroatom compounds move into the aqueous phase, and extraction is realized through formation of a complex with carbonic acid ions. The ionic carbonic acid formation may be a function of pressure, temperature, and salt concentration in the extraction vessel. The concentration ratio of carbonic acid ions to bicarbonate ions ($HCO_3^-$) ions increases with the increase in temperature and pressures in the range of about 1 bar to about 300 bar. Dissociated carbonic acid drives the extraction of the polar compounds. The selectivity of this temporary complex formation between the dissociated carbonic acid and the heteroatom compounds is dependent on the molecular structure of the heteroatom compound and/or any electronegativity difference between the carbon and heteroatoms in the heteroatom compound.

Electronegativity differences may relate to strengths of dipole moments, i.e., the polarity, of the heteroatom compounds and also may relate to extraction efficiency at a given set of tuning parameters.

In some non-limiting embodiments, the tunable solvent may be tuned or modified by adjusting the pressure of the solvent system so that the solvent is tuned to attract or complex with a target organic heteroatom compound that has a certain polarity. By using such a selective solvent, interference from impurities that are not the target organic heteroatom compound may be less likely than in other separation processes. For example, separation processes that separate impurities based on, for example, the boiling point and condensation point of impurities, may be likely to separate impurities other than the target organic heteroatom compound, particularly ones that have a similar boiling point as the target organic heteroatom compound. In contrast, tunable solvents used in the methods according to embodiments herein may be precisely tuned so that they selectively separate only a target heteroatom compound or small class of heteroatom compounds.

In other embodiments, the tunable solvent may be tuned or modified, such as by adjusting the pressure of the solvent system, so that the tunable solvent separates the organic heteroatom compounds from the hydrocarbons. For example, in some embodiments, the tunable solvent may be tuned or modified to attract or complex with the most polar organic heteroatom compound as a solute in the solvent system. In other embodiments, the tunable solvent may be tuned or modified to attract organic heteroatom compounds having even weak polarity, such as, for example, weak dipole moments.

In addition to pressure modification, temperature modification may be used to tune the equilibrium of the tunable solvent system. For example, temperature may be used to affect the solubility of heterocyclic compounds. Increased solubility of the heterocyclic compounds may increase the extraction and selectivity of the solvent-organic system and, thereby, temperature may be used to fine-tune the tunable solvent.

In the methods for producing the hydrocarbon raffinate, as well as the methods for separating or extracting organic heteroatom compounds and polynuclear aromatic hydrocarbons from a hydrocarbon feedstock according to some embodiments, the hydrocarbon feedstock, such as, for example, crude oil or crude oil fraction, may be contacted with a tunable solvent that is capable of being modified, or tuned, to attract one or more organic heteroatom compounds into the solvent system as a solute. Contacting of the hydrocarbon feedstock with the tunable solvent may include feeding the hydrocarbon feedstock into a contactor or an extraction vessel, and feeding the aqueous solvent into the contactor or extraction vessel to form an extraction mixture of the aqueous solvent with the hydrocarbon feedstock. The tunable solvent may be formed from pressurized carbon dioxide, water, and optional modifiers. In some embodiments, the tunable solvent may be pre-mixed with the hydrocarbon feedstock to form the extraction mixture, and the extraction mixture may be fed to the extraction vessel. Changes in pressure of the solvent system can be used to tune the tunable solvent to attract specific organic heteroatom compounds into the solvent system as a solute. Accordingly, the methods may include establishing an extraction-vessel pressure and an extraction-vessel temperature of the extraction mixture in the extraction vessel that together tune the aqueous solvent to selectively form a solvent complex with the at least one organic heteroatom compound.

The solubility of aqueous phase carbon dioxide may increase with respect to increasing pressure of the solvent system employed in the methods according to some embodiments. In addition, the solubility of gaseous carbon dioxide in water increases as the temperature of the solvent system decreases. However, to maintain supercritical behavior of carbon dioxide in the solvent system, according to embodiments, the temperature and the pressure of the solvent system may be maintained above the critical temperature and pressure of carbon dioxide. As a result, the combined effect of the carbon dioxide and water in the tunable solvent achieves unique properties that allow the solvent to be used to attract or complex with heteroatom compounds from the hydrocarbon feedstock into the solvent system as a solute.

The carbon dioxide in the tunable solvent system according to embodiments herein may play multiple roles in the heteroatom compound extraction or separation process. Supercritical carbon dioxide may diffuse through the hydrocarbon feedstock, because it has good diffusivity and lower viscosity than do other solvents, which allows the carbon dioxide to better initiate the mass transfer that attracts the organic heteroatom compounds into the solvent system as a solute. For example, in embodiments, the polar nature of heteroatom compounds in general may bring the organics into a reversible aqueous phase of the solvent.

In some embodiments, the temperature of the solvent system, the pressure of the solvent system, or both, may be adjusted to tune the solvent system to contain more or fewer ions, such as, for example, $HCO_3^-$, thereby making the solvent system more or less attractive to polar refractory heteroatom compounds or to tune the solvent system's ability to form complexes between the tunable solvent and the organic heteroatom compound. To remove target heteroatom compound components, such as, for example, target organic sulfur compounds, target organic nitrogen compounds, target organometallic compounds, or combinations thereof, properties such as boiling point, as well as the chemical structures of the target heteroatom compounds themselves, may affect temperature and pressure parameters that result in selectivity of the solvent system. Non-limiting examples of heteroatom compounds that may be removed from hydrocarbon feedstocks in various embodiments include pyrroles, pyridines, quinolines, indoles, carbazoles, benzothiophenes, thiophenes, dibenzothiophenes, 7,8,9,10-tetrahydro-benzo[b]naphtho[2,3-d]thiophene, nickel-tetraphenyl-porphyrin, and vanadyl-tetraphenyl-porphyrin. It should be understood that the heteroatom compounds specifically listed are only exemplary and are not intended to be an exhaustive list of all heteroatom compounds that may be removed according to embodiments of this disclosure.

The heteroatom compounds that may be removed from hydrocarbon feedstocks according to various embodiments may have varieties of chemical structures. Thus, the compounds that are to be removed from the hydrocarbon feedstocks will have an impact and can determine the appropriate amount of solvent tuning required, such as, for example, adjustments of the pressure and/or temperature of the solvent system. Additionally, in embodiments, the selection of a tunable solvent for the separation of a specific organic heteroatom compound from hydrocarbons may impact the mass transfer of the organic heteroatom compounds from a hydrocarbon phase to a solvent phase that result from phase separation of the extraction mixture.

A single stream or a series of streams of tunable solvents may be used for selectively separating heteroatom compounds, such as, for example, organic sulfur compounds, organic nitrogen compounds, and/or organometallic compounds, from hydrocarbons. In embodiments, the separation may proceed by running the tunable solvent and the hydrocarbons in a series of cross-current or counter-current contactors or extraction vessels, such as, for example, packed bed contactors, fluidized bed contactors, and baffled contactors.

Without intent to be bound by theory, it is believed that because various organic heteroatom compounds have polarities, they can be separated from a hydrocarbon phase into an aqueous phase of the solvent through the activity of $HCO_3^-$ ions present in the tunable solvent. It is believed that temporary complexes may form between the polar heteroatom compounds and the $HCO_3^-$ ion. For example, a temporary complex that is formed between dibenzothiophene and $HCO_3^-$ is shown below:

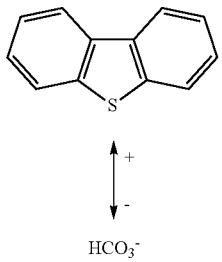

Organic heteroatom compounds containing nitrogen may also have polar behavior. However, unlike organic sulfur compounds, $HCO_3^-$ or $H^+$ may attract the organic nitrogen compounds because, in certain compounds, the nitrogen bond may have a positive or negative polarity. For example, in carbazole, the N—H bond may take on a positive or negative polarity and, thus, the following complexes may be formed between the tunable solvent and carbazole:

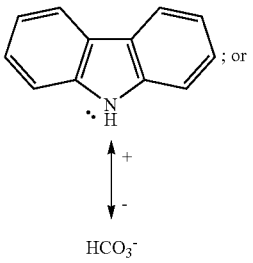

-continued

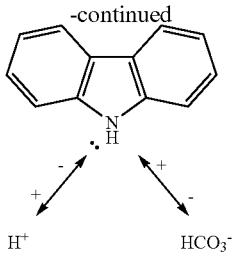

The above depictions of heteroatom complexes are exemplary only and are not intended to limit the scope of any embodiment herein. Similar reaction mechanisms may occur with respect to separations of other organic heteroatom compounds such as, for example, organic sulfur-containing heterocyclic compounds, organic nitrogen-containing heterocyclic compounds, and organometallic compounds.

The tunable and switchable smart solvent system for removing or extracting of heteroatom compounds from crude fractions is nontoxic, nonflammable, recyclable, environmentally friendly, without serious disposal issues, and not susceptible to causing cross-contamination of crude fractions. As will be described in greater detail below, once heteroatom compounds are removed from the hydrocarbon feedstock, PAHs may also be recovered from the resulting heteroatom-compound lean stream in an aprotic solvent system, optionally containing a protic cosolvent. Because both PAHs and heteroatom compounds are generally soluble in aprotic solvent systems, while heteroatom compounds (but not PAHs) are soluble in the tunable solvent system including carbon dioxide, in the extraction system 1 according to some embodiments the heteroatom compounds are removed first from the hydrocarbon feedstock, followed by the PAH compounds.

Figure 2:
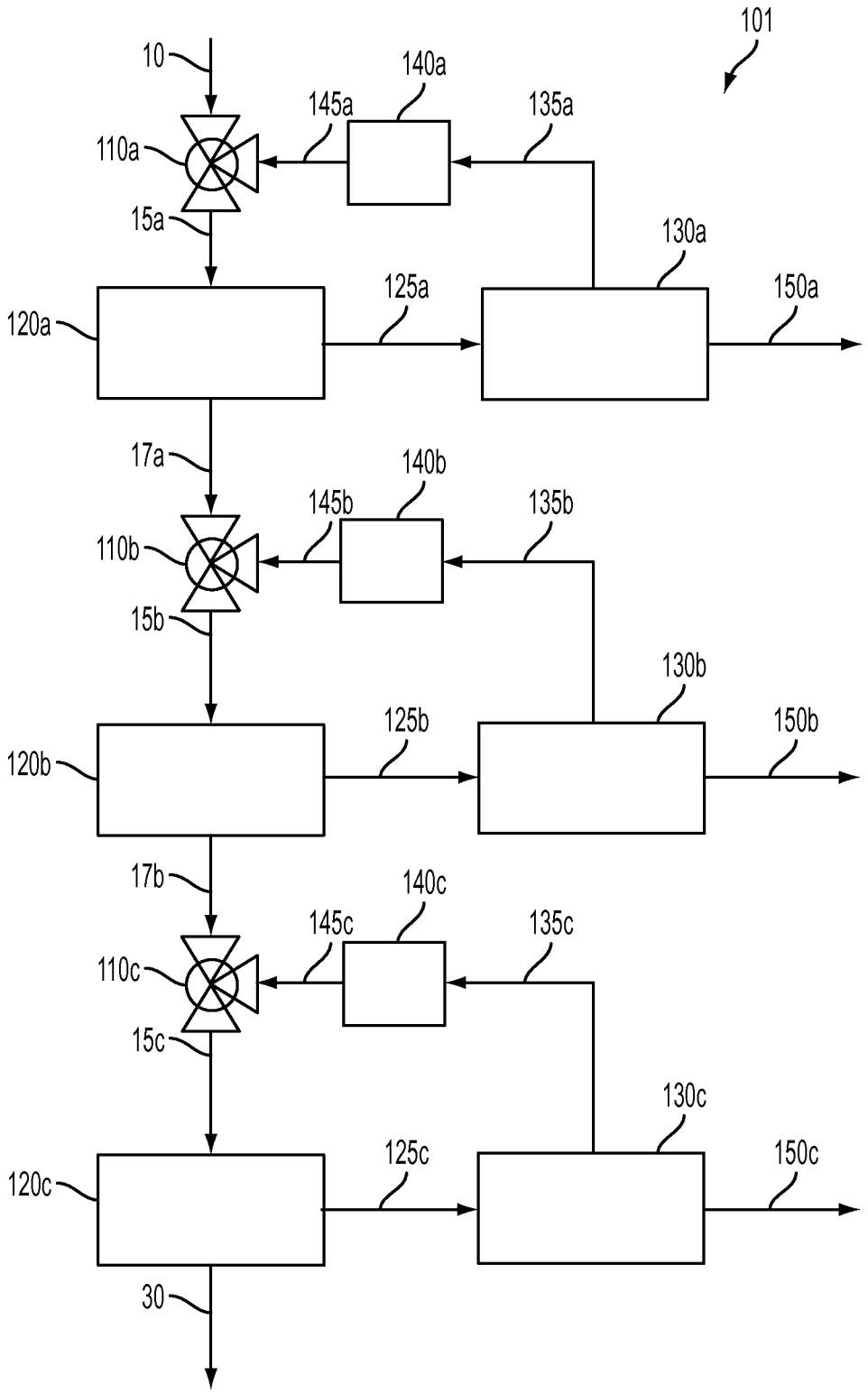
FIG. 2 is a schematic diagram of components of an exemplary extraction system according to FIG. 1 for separating or extracting organic heteroatom compounds in embodiments of methods for separating or extracting organic heteroatom compounds and polynuclear aromatic hydrocarbons from a hydrocarbon feedstock described herein.

Referring again to the extraction system 1 of FIG. 1, which may be implemented in embodiments of methods for producing the hydrocarbon raffinate, as well as the methods for separating or extracting organic heteroatom compounds and polynuclear aromatic hydrocarbons from a hydrocarbon feedstock, the heteroatom-compound extraction system 100 may be configured as a step-wise HC extraction system 101, shown schematically in FIG. 2. According to other embodiments, the heteroatom-compound extraction system 100 of FIG. 1 may be configured as a post-separation HC extraction system 102, shown schematically in FIG. 4. Both the step-wise HC extraction system 101 and the post-separation HC extraction system 102 include multiple extraction vessels (such as 120, 120*a*, 120*b*, 120*c*, 120*d*), of which the extraction vessel 120 of FIG. 3 is one exemplary embodiment.

In the step-wise HC extraction system 101, the hydrocarbon feedstock 10 is subjected to multiple extractions of heteroatom compounds, in which each extraction removes a portion of the heteroatom compounds according to their polarities. The heteroatom-compound lean stream leaves the step-wise HC extraction system 101 after the multiple extractions of the heteroatom compounds. In the post-separation HC extraction system 102, the hydrocarbon feedstock 10 is subjected to an initial extraction of substantially all of the heteroatom compounds, such as from 80% to 100%, from 90% to 100%, from 95% to 100%, from 98% to 100%, or from 98% to 99%. The heteroatom-compound lean stream leaves the post-separation HC extraction system 102 after the initial extraction, and the heteroatom-compound rich stream 20 is subjected to further extractions to remove one or more additional portions of the heteroatom compounds according to their polarities.

Whether configured as a step-wise HC extraction system 101 (FIG. 2) or a post-separation HC extraction system 102 (FIG. 4), the heteroatom-compound extraction system 100 (FIG. 1) according to some embodiments includes at least one extraction vessel 120. An exemplary embodiment of an extraction vessel 120 is provided in FIG. 3. The extraction vessel 120 includes an extraction-vessel body 500. An extraction feed 15 may be introduced into the bottom of extraction-vessel body 500, such as by bottom spray nozzles 512. In some embodiments, the extraction feed 15 may include a mixture of hydrocarbon feedstock and tunable solvent formed prior to introduction of the extraction feed 15 into the extraction-vessel body 500. For example, as shown in FIG. 2, the hydrocarbon feedstock 10 may be mixed with tunable solvent from first solvent input 145*a* in a first three-way valve 110*a* to form first extraction feed 15*a* before being introduced into a first extraction vessel 120*a*. In other embodiments, the extraction feed 15 may be the hydrocarbon feedstock, such that mixture of the hydrocarbon feedstock occurs within the extraction-vessel body 500. A tunable solvent feed 18 may introduce tunable solvent into the top of the extraction-vessel body 500, such as by top spray nozzles 514.

Figure 3:
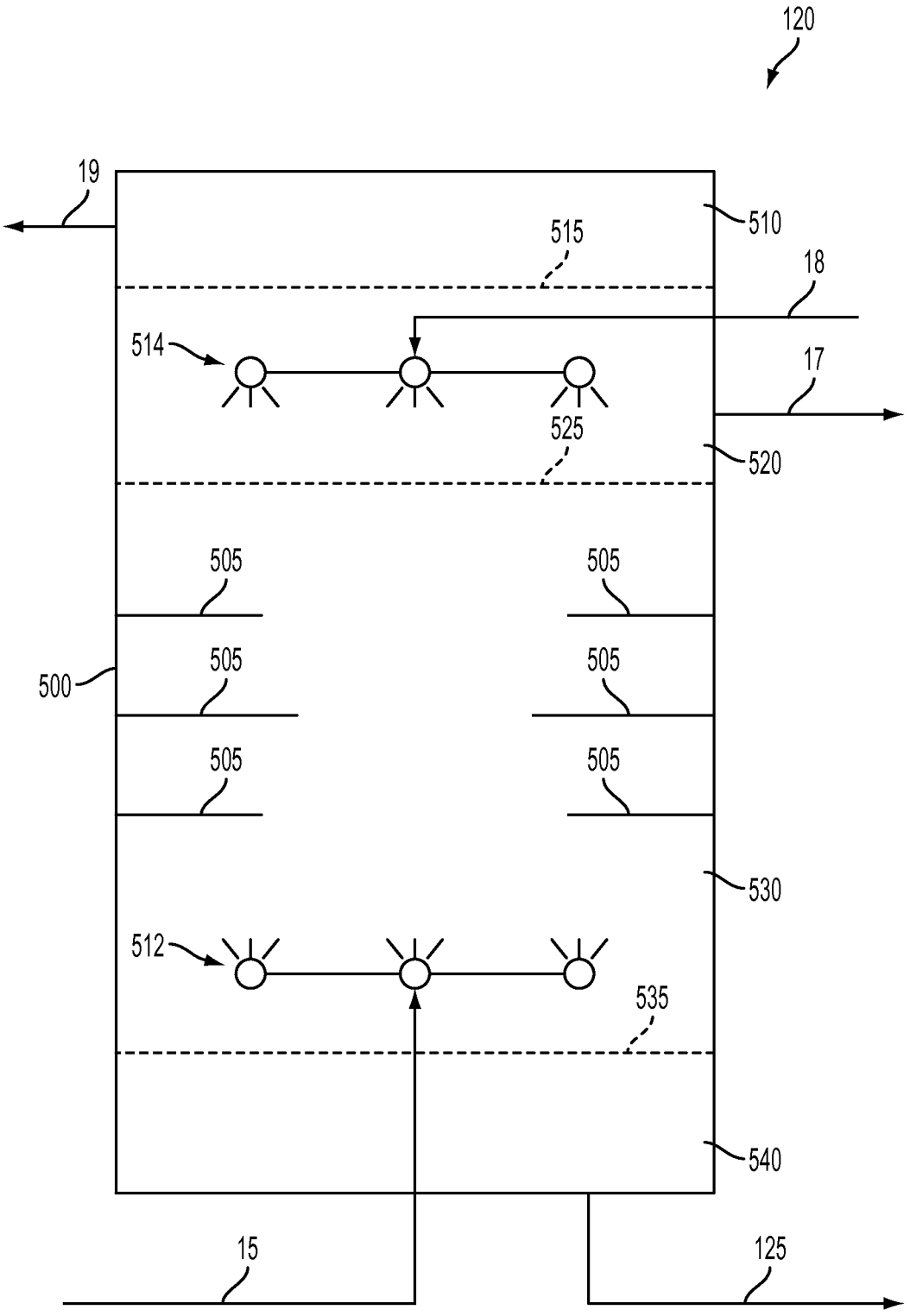
FIG. 3 is a schematic of an extraction vessel for separating or extracting organic heteroatom compounds using a tunable smart solvent system.

Referring to FIG. 3, as the extraction feed 15 enters the extraction-vessel body 500, droplets and sprays of hydrocarbons in the extraction feed 15 may flow upward, such as by spray propulsion and by filling the bottom of the extraction-vessel body 500. Droplets and sprays of the tunable solvent from the tunable solvent feed 18 may flow downward in the extraction-vessel body 500, such as by spray propulsion and gravitational forces. In some embodiments, the extraction feed 15 and the tunable solvent may be tailored such that the density of the tunable solvent is greater than the density of the hydrocarbons in the extraction feed 15. This difference in density may cause the tunable solvent to contact the components of the extraction feed 15 and traverse through the hydrocarbon phase. Thus, in embodiments, the extraction feed 15 and the tunable solvent proceed in counter-flow contact within the extraction-vessel body 500, thereby increasing residence time of the contact between the extraction feed 15 and the tunable solvent. The extraction-vessel body 500 may optionally include structures such as baffles 505 or rotating mixing devices (not shown) to facilitate intermixing of the components of the extraction feed 15 with the tunable solvent.

In some embodiments, droplets derived from components of the extraction feed 15 and the tunable solvent may coalesce to form separate homogeneous phases. In embodiments in which the hydrocarbons of the extraction feed 15 are more dense than the tunable solvent, the flow of these components into the extraction-vessel body 500 may be reversed (i.e., the extraction feed 15 may be introduced into the top of the extraction-vessel body 500, and the tunable solvent feed 18 may be introduced into the bottom of the extraction-vessel body 500). During contact between the extraction feed 15 and the tunable solvent, organic heteroatom compounds may be attracted into the solvent phase of the tunable solvent as solutes, for example, by forming complexes with the tunable solvent. Thus, after the extraction feed 15 and the tunable solvent interact for a period of time, a heteroatom-compound lean stream 17 may be extracted from the middle of the extraction-vessel body 500. The tunable solvent, which has become rich with organic heteroatom compounds, may be removed from the bottom of the extraction-vessel body 500 as a heteroatom-compound rich stream 125.

During the contacting of the extraction feed 15 and the tunable solvent in the extraction vessel 120, the pressure and/or temperature within the extraction-vessel body 500 may be modified to tune the solvent to have ions that attract the most polar components in the extraction feed 15. Target organic heteroatom compounds, such as, for example, organic sulfur heterocyclic compounds, organic nitrogen heterocyclic compounds, and organometallic compounds naturally have polarities in the molecular structures. The relative polarities of these compounds may vary. For example, some organometallic compounds may exhibit more polar behavior (i.e., may have a higher polarity) than do sulfur-containing heterocyclic compounds or nitrogen-containing heterocyclic compounds. To illustrate the polar behavior of an exemplary heterocyclic compound, consider that dibenzothiophene has a sulfur atom that is more electropositive than its other, bonded carbon atoms. Particularly, the delocalized electrons of dibenzothiophene may be drawn inside of its ring structure and, thus, the sulfur atoms' outer shell may also be drawn inside toward the electrons. As a result, the sulfur atom attached to the rings becomes electropositive and provides the dibenzothiophene with polar properties.

Referring again to FIG. 3, during the contact of the extraction feed 15 and the tunable solvent in the extraction-vessel body 500, multiple phases are formed that accomplish the separation of the extraction feed 15 into the heteroatom-compound lean stream 17 and the heteroatom-compound rich stream 125. In particular, the fluids resident in the extraction-vessel body 500 may be divided into four phase regions 510, 520, 530, and 540. Each phase region is separated from adjacent phase region(s) by phase boundaries 515, 525, 535, represented in FIG. 3 by dotted lines. According to some embodiments, the top of the extraction-vessel body 500 may comprise solvent phase 510 that includes or consists essentially of supercritical and subcritical carbon dioxide from the tunable solvent. Below phase boundary 515 is lean phase 520, which may include hydrocarbons lean in heteroatom compounds and carbon dioxide. In embodiments, the heteroatom-compound lean stream 17 extracted from the extraction-vessel body 500 may be extracted from the lean phase 520. Below phase boundary 525 is mixed phase 530, which may include a mixture of aqueous carbon dioxide, water, hydrogen ions, carbonic acid, hydrocarbons, and supercritical carbon dioxide. At the bottom of the extraction vessel is rich phase 540, which may comprise aqueous carbon dioxide, hydrogen ions, water, carbonic acid, and solvent rich in heteroatom compounds as solutes. The heteroatom-compound rich stream 125 that is extracted from the extraction vessel may be extracted from rich phase 540.

The development of phases in the extraction-vessel body 500 may be influenced by the pressure of the solvent system within the extraction-vessel body 500. For example, complexes between organic heteroatom compounds and the tunable solvent may be driven by pressure increases or decreases in the solvent system. Without intent to be bound by theory, it is believed that an increase of pressure on the tunable solvent promotes a shift in an equilibrium between $H_2CO_3(aq)$ and $H^+(aq)+HCO_3^-(aq)$. In addition, the solubility of carbon dioxide in water increases as the temperature of the solvent system increases. However, once a complex forms between the $HCO_3^-$ and a heteroatom compound, a reaction is promoted whereby $CO_2$ forms $H_2CO_3(aq)$ in the water, which can dissociate into $H^+(aq)+HCO_3^-(aq)$ to maintain the concentration of $HCO_3^-(aq)$. Thus, equilibrium is established immediately after a complex forms through the disassociation of an equivalent of $H_2CO_3(aq)$ into $H^+(aq)+HCO_3^-(aq)$. Accordingly, in embodiments, increasing the pressure in the extraction-vessel body 500 promotes the formation of the complex between one $HCO_3^-(aq)$ ion and one molecule of the organic heteroatom compound. Similarly, a decrease in pressure will drive the above mechanism in the opposite direction and will either decrease the formation of complexes between ions and organic heteroatom compounds or decompose any complexes that already exist in solution. Thus, it should be apparent that the organic heteroatom compound may be ejected from the solvent or may be made to aggregate or precipitate out of the solvent by decreasing the pressure.

The pressure applied in the extraction-vessel body 500 may be varied depending on the tunable solvent that is used and the target organic heteroatom compounds sought to be extracted. In some embodiments, the pressure may be varied to produce more or less $HCO_3^-$ to attract specific organic heteroatom compounds according to the polarity of the specific heteroatom compounds. In exemplary embodiments, the pressure in the extraction-vessel body 500 during an extraction of heteroatom compounds may be from about 2 bar to about 300 bar, such as from about 20 bar to about 275 bar. In some embodiments, the pressure in the contractor may be from about 50 bar to about 250 bar, such as from about 75 bar to about 225 bar. In yet other embodiments, the pressure in the extraction vessel may be from about 100 bar to about 200 bar. In still other embodiments, the pressure in the contractor may be from about 125 bar to about 175 bar. In still other embodiments, the pressure in the extraction vessel may be from about 2 bar to about 20 bar, such as about 18 bar. It should be understood that the above ranges are intended to include each point between the disclosed endpoints, and that each pressure point between 2 bar and 300 bar is envisioned in this disclosure.

The temperature in the extraction vessel 120 may be varied according to the tunable solvent that is used and the target organic heteroatom compounds being extracted. In embodiments in which carbon dioxide is the tunable solvent, the temperature in the extraction vessel 120 may be greater than or equal to the critical temperature of carbon dioxide, such as about 20° C. greater than the critical temperature of carbon dioxide. In some embodiments, the temperature in the extraction vessel 120 may be greater than or equal to about 40° C. above the critical temperature of carbon dioxide, such as about 60° C. greater than the critical temperature of carbon dioxide. In embodiments, the temperature in the extraction vessel 120 may be less than or equal to about 150° C., such as less than or equal to about 80° C.

Referring to FIG. 2, in the step-wise HC extraction system 101, multiple portions of heteroatom compounds are extracted sequentially from the hydrocarbon feedstock 10, and a heteroatom-compound lean stream 30 that emerges from the step-wise HC extraction system 101 is sent to a PAH extraction system 300 (FIG. 1) after the multiple portions of heteroatom compounds have been removed. In the step-wise HC extraction system 101, the hydrocarbon feedstock 10 may be mixed with tunable solvent from a first solvent input 145*a* in a first three-way valve 110*a*, for example, to form a first extraction feed 15*a* that is introduced into a first extraction vessel 120*a*. The first extraction vessel 120*a* may be configured in the same manner as the extraction vessel 120 of FIG. 3, described above. The hydrocarbon feedstock 10 may contain crude oil or crude oil fractions, particularly crude oil fractions having a boiling point range of from about 165° C. to about 430° C. The hydrocarbon feedstock 10 may contain high levels of heteroatom compounds. The temperature of the hydrocarbon feedstock 10 may be is adjusted or maintained to from 25° C. to about 150° C., depending on the type of heteroatom compounds present in the hydrocarbon feedstock 10.

A first heteroatom-compound rich stream 125*a* leaves the first extraction vessel 120*a* and is transferred to a first ejector vessel 130*a*. In the first ejector vessel 130*a*, the first heteroatom-compound rich stream 125*a*, which contains a mixture of heteroatom compounds and tunable solvent, may be depressurized or cooled to cause the heteroatom compounds to come out of solution. When the first ejector vessel 130*a* is depressurized, the reversible carbonic acid becomes less acidic as carbonic acid reverts to aqueous $CO_2$ and ejects the heteroatom compounds from the solvent phase. In some embodiments, the depressurization of the first ejector vessel 130*a* may occur continuously or semi-continuously during the ejection process. In other embodiments, the depressurization may be conducted in stages in a series of different recovery vessels, so as to eject the least polar heteroatom compounds first, followed by filtering or adsorption of the heteroatom compounds.

The heteroatom compounds may be transferred out of the first ejector vessel 130*a* as a first heteroatom-compound recovery stream 150*a* to be sent to a heteroatom-compound fractionator 200 (see FIG. 1). In some embodiments, the first heteroatom-compound recovery stream 150*a* may be formed by filtering the heteroatom compounds in the first ejector vessel 130*a*, adsorbing the heteroatom compounds onto an adsorbent, or by solvating the heteroatom compounds in an aromatic solvent. The tunable solvent components such as carbon dioxide and water in the first ejector vessel 130*a* may be sent as a first solvent-recycle stream 135*a* to a first solvent regenerator 140*a*. The first solvent regenerator 140*a* may then feed the tunable solvent back to additional portions of hydrocarbon feedstock 10 through the first solvent input 145*a*.

A first heteroatom-compound lean stream 17*a* is transferred from the first extraction vessel 120*a* to a second three-way valve 110*b* to be mixed with tunable solvent from a second solvent input 145*b* and sent to a second extraction vessel 120*b* as a second extraction feed 15*b*. The second extraction feed 15*b* may be adjusted to or maintained at a temperature of from about 25° C. to about 150° C. In the second extraction vessel 120*b*, an additional portion of heteroatom compounds is removed from the second extraction feed 15*b*. In some embodiments, the conditions in the second extraction vessel 120*b* may be chosen to target extraction of heteroatom compounds having a lower degree of polarity than that of the heteroatom compounds extracted from the first extraction feed 15*a* in the first extraction vessel 120*a*. For example, the pressure of the second extraction vessel 120*b* may be maintained at a higher level than was used to conduct the extraction in the first extraction vessel 120*a*. Similar to the first extraction process in the first extraction vessel 120*a*, a second heteroatom-compound rich stream 125*b* is transferred from the second extraction vessel 120*b* to a second ejector vessel 130*b*. The second ejector vessel 130*b* is depressurized. When the second ejector vessel 130*b* is depressurized, the reversible carbonic acid becomes less acidic as carbonic acid reverts to aqueous $CO_2$ and ejects the heteroatom compounds from the solvent phase. In some embodiments, the depressurization of second ejector vessel 130*b* may occur continuously or semi-continuously during the ejection process. In other embodiments, the depressurization may be conducted in stages in a series of different recovery vessels, so as to eject the least polar heteroatom compounds first, followed by filtering or adsorption of the heteroatom compounds.

A second heteroatom-compound recovery stream 150*b* may be sent to a heteroatom-compound fractionator 200 (see FIG. 1) and the components of the tunable solvent in the second ejector vessel 130*b* may be sent as a second solvent-recycle stream 135*b* to a second solvent regenerator 140*b*. In some embodiments, the second heteroatom-compound recovery stream 150*b* may be formed by filtering the heteroatom compounds in the second ejector vessel 130*b*, adsorbing the heteroatom compounds onto an adsorbent, or by solvating the heteroatom compounds in an aromatic solvent. The second solvent regenerator 140*b* may then feed the tunable solvent back to additional portions of the first heteroatom-compound lean stream 17*a* through the second solvent input 145*b*.

A second heteroatom-compound lean stream 17*b* is transferred from the second extraction vessel 120*b* to a third three-way valve 110*c* to be mixed with tunable solvent from a third solvent input 145*c* and sent to a third extraction vessel 120*c* as a third extraction feed 15*c*. The third extraction feed 15*c* may be adjusted to or maintained at a temperature of from about 25° C. to about 150° C. In the third extraction vessel 120*c*, an additional portion of heteroatom compounds is removed from the third extraction feed 15*c*. In some embodiments, the conditions in the third extraction vessel 120*c* may be chosen to target extraction of heteroatom compounds having a lower degree of polarity than those of the heteroatom compounds extracted from the first extraction feed 15*a* in the first extraction vessel 120*a* and from the second extraction feed 15*b* in the second extraction vessel 120*b*. For example, the third extraction vessel 120*c* may be maintained at a higher pressure than was used to conduct the extractions in the first extraction vessel 120*a* and the second extraction vessel 120*b*. Similar to the first extraction process in the first extraction vessel 120*a*, a third heteroatom-compound rich stream 125*c* is transferred from the third extraction vessel 120*c* to a third ejector vessel 130*c*. The third ejector vessel 130*c* is depressurized. When the third ejector vessel 130*c* is depressurized, the reversible carbonic acid becomes less acidic as carbonic acid reverts to aqueous $CO_2$ and ejects the heteroatom compounds from the solvent phase. In some embodiments, the depressurization of third ejector vessel 130*c* may occur continuously or semi-continuously during the ejection process. In other embodiments, the depressurization may be conducted in stages in a series of different recovery vessels, so as to eject the least polar heteroatom compounds first, followed by filtering or adsorption of the heteroatom compounds.

A third heteroatom-compound recovery stream 150*c* may be sent to a heteroatom-compound fractionator 200 (see FIG. 1) and the components of the tunable solvent in the third ejector vessel 130*c* may be sent as a third solvent-recycle stream 135*c* to a third solvent regenerator 140*c*. In some embodiments, the third heteroatom-compound recovery stream 150*c* may be formed by filtering the heteroatom compounds in the third ejector vessel 130*c*, adsorbing the heteroatom compounds onto an adsorbent, or by solvating the heteroatom compounds in an aromatic solvent. The third solvent regenerator 140*c* may then feed the tunable solvent back to additional portions of the second heteroatom-compound lean stream 17*b* through the third solvent input 145*c*.

In a non-limiting illustrative embodiment, the first extraction vessel 120*a* may be operated at pressure $P_1$ from 2 bar to 300 bar, so as to target heteroatom compounds having relatively high polarities. The second extraction vessel 120*b* may be operated at pressure $P_2$ from 2 bar to 300 bar, where $P_2>P_1$, so as to target heteroatom compounds having polarities lower than those of the heteroatom compounds extracted in the first extraction vessel 120*a*. The third extraction vessel 120*c* may be operated at pressure $P_3$ from 2 bar to 300 bar, where $P_3>P_2>P_1$, so as to target heteroatom compounds having the lowest polarities in the original hydrocarbon feedstock.

From the third extraction vessel 120*c*, a heteroatom-compound lean stream 30 emerges as a substantially hydrocarbon phase rich in the polynuclear aromatic hydrocarbons that were present in the hydrocarbon feedstock 10, but from which all or a substantial portion such as 80%, 90%, 95%, 99%, or 99.9% of the heteroatom compounds have been removed. It should be understood that though the step-wise HC extraction system 101 has been illustrated in FIG. 2 as including only three extraction vessels, namely, first extraction vessel 120*a*, second extraction vessel 120*b*, and third extraction vessel 120*c*, that more or fewer extraction vessels may be employed. For example, the step-wise HC extraction system 101 may include only two extraction vessels or may include four, five, ten, twenty, or more than twenty extraction vessels, depending on the cost effectiveness of the contemplated step-wise extraction system. In particular, more than three extraction vessels may be advantageous if numerous classes of heteroatom compounds are targeted, all of which vary by a quantifiable degree of polarity, such that the conditions of the tunable solvent in the extraction vessels can be precisely tailored to extract one of the classes in each individual extraction vessel.

Figure 4:
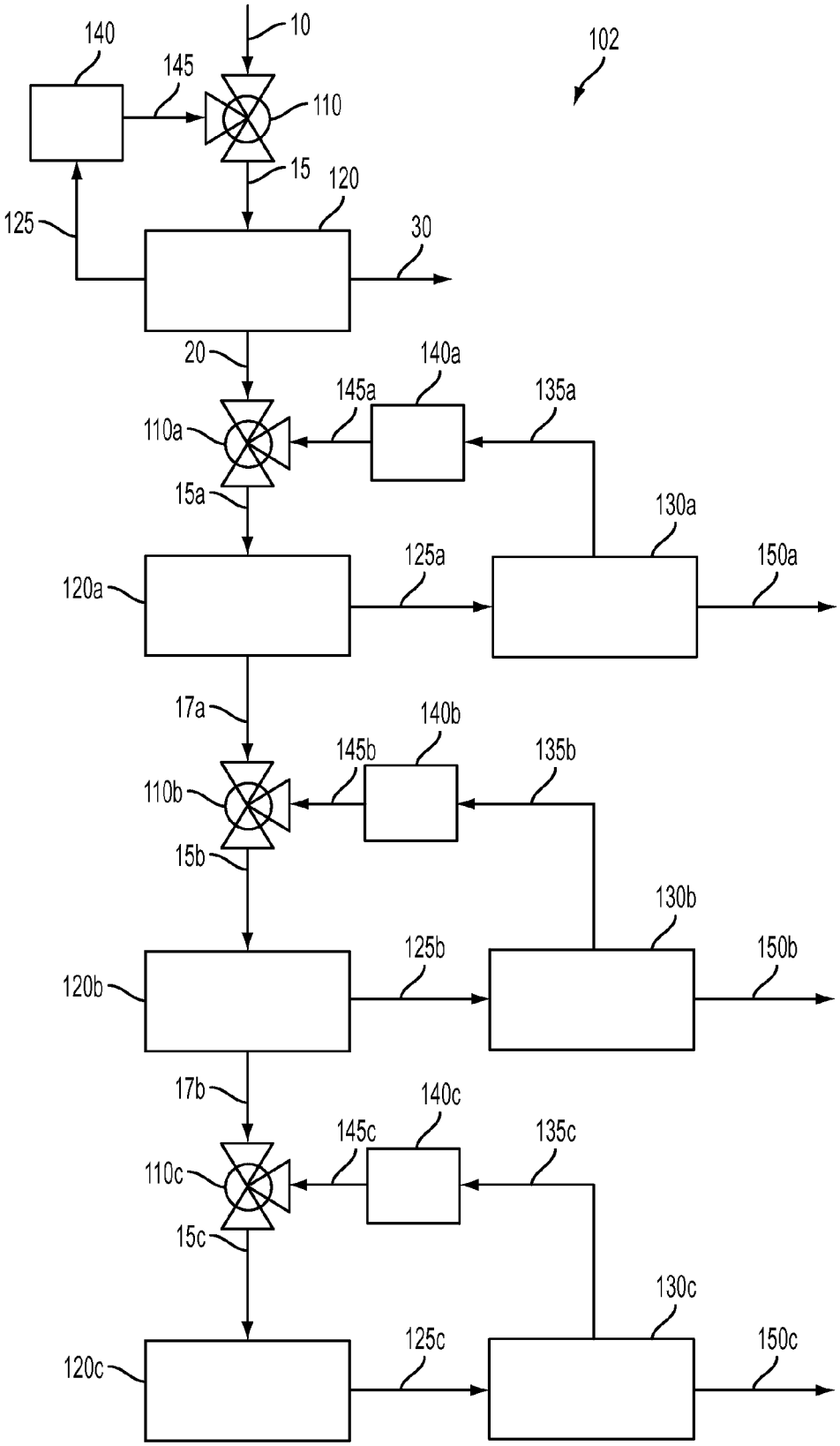
FIG. 4 is a schematic diagram of components of an exemplary extraction system according to FIG. 1 for separating or extracting organic heteroatom compounds in embodiments of methods for separating or extracting organic heteroatom compounds and polynuclear aromatic hydrocarbons from a hydrocarbon feedstock described herein.

Referring to FIG. 4, the post-separation HC extraction system 102 is a variation of the step-wise HC extraction system 101 of FIG. 2 in that in the post-separation HC extraction system 102, the hydrocarbon feedstock 10 is subjected to an initial extraction of substantially all of the heteroatom compounds present in the hydrocarbon feedstock 10. In the post-separation HC extraction system 102, the hydrocarbon feedstock 10 may be mixed in a three-way valve 110 with tunable solvent from a solvent input 145 and transferred as an extraction feed 15 to an extraction vessel 120. The pressure and temperature conditions in the extraction vessel 120 may be adjusted to tune the tunable solvent, such that substantially all of the heteroatom compounds in the extraction feed 15 are solvated in an aqueous phase that leaves the extraction vessel 120 as a heteroatom-compound rich stream 20, while the PAH components of the extraction stream are retained in an organic phase that leaves the extraction vessel 120 as a heteroatom-compound lean stream 30. The heteroatom-compound lean stream 30 may be transferred from the extraction vessel 120 to a PAH extraction system (see FIG. 1). The heteroatom-compound rich stream 20 may be transferred to a first extraction vessel 120*a* after being mixed with tunable solvent from a first solvent input 145*a* in a first three-way valve 110*a* to form a first extraction feed 15*a*.

In the exemplary embodiment of FIG. 4, the first extraction feed 15*a*, which is, unlike in the step-wise HC extraction system 101, nearly devoid of PAHs, may be subjected to multiple extractions of heteroatom compounds in the first extraction vessel 120*a*, a second extraction vessel 120*b*, and a third extraction vessel 120*c*. Heteroatom-compound rich streams 125*a*, 125*b*, 125*c* from the extraction vessels 120*a*, 120*b*, 120*c* are sent to a respective ejector vessel 130*a*, 130*b*, 130*c*, from each of which a heteroatom-compound recovery stream 150*a*, 150*b*, 150*c* is sent to a heteroatom-compound fractionator 200 (see FIG. 1). From the ejector vessels 130*a*, 130*b*, 130*c*, solvent-recycle streams 135*a*, 135*b*, 135*c* may be sent to solvent regenerators 140*a*, 140*b*, 140*c* to be reintroduced back into the extraction vessels 120*a*, 120*b*, 120*c* through the solvent inputs 145*a*, 145*b*, 145*c* and the three-way valves 110*a*, 110*b*, 110*c*.

As with the step-wise HC extraction system 101 of FIG. 2, it should be understood that the post-separation HC extraction system 102 of FIG. 4 has been illustrated as including only three extraction vessels, namely, first extraction vessel 120*a*, second extraction vessel 120*b*, and third extraction vessel 120*c*, that more or fewer extraction vessels may be employed. For example, the post-separation HC extraction system 102 may include only two extraction vessels or may include four, five, ten, twenty, or more than twenty extraction vessels, depending on the cost effectiveness of the contemplated step-wise extraction system. In particular, more than three extraction vessels may be advantageous if numerous classes of heteroatom compounds are targeted, all of which vary by a quantifiable degree of polarity, such that the conditions of the tunable solvent in the extraction vessels can be precisely tailored to extract one of the classes in each individual extraction vessel.

Figure 5:
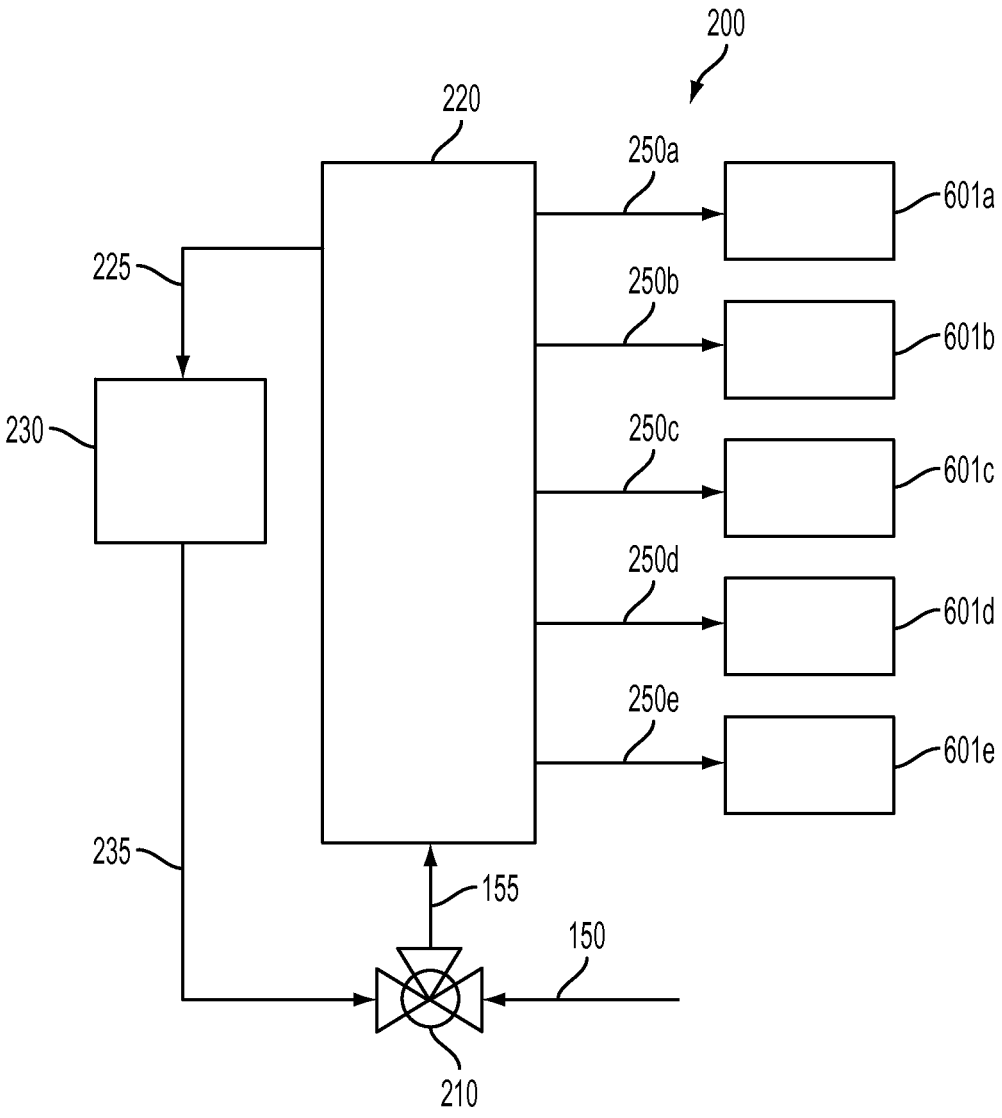
FIG. 5 is a schematic diagram of components of an exemplary extraction system according to FIG. 1 for fractionating organic heteroatom compounds from a heteroatom-rich stream in embodiments of methods for separating or extracting organic heteroatom compounds and polynuclear aromatic hydrocarbons from a hydrocarbon feedstock described herein.

Referring to FIGS. 1 and 5, the heteroatom-compound fractionator 200 of the extraction system 1 will now be described. In the methods for recovering heteroatom compounds and PAHs from a hydrocarbon stream, a heteroatom-compound recovery stream 150 from the heteroatom-compound extraction system 100 may be mixed with an HC-extraction solvent system contained in HC solvent stream 235 in a three-way valve 210 or other suitable device to form an HC fractionation stream 155. The HC-extraction solvent system may include any solvents in which heteroatom compounds in the heteroatom-compound recovery stream 150 are soluble, particularly solvents most conducive to separation processes such as fractional distillation. In exemplary embodiments, the HC-extraction solvent system may include aromatic solvents, N-methylpyrrolidone (NMP), dimethylsulfoxide (DMSO), or combinations thereof.

The HC fractionation stream 155 may be introduced into a fractionation vessel 220, in which the HC fractionation stream 155 undergoes a separation process. In one embodiment, the separation process is dependent on boiling point variations of various heteroatom compound components in the HC fractionation stream 155. For example, the separation process may include fractional distillation. The separation process separates the HC fractionation stream 155, which includes a mixture of heteroatom compounds, into multiple heteroatom-compound solute fractions 250*a*, 250*b*, 250*c*, 250*d*, 250*e*. The multiple heteroatom-compound solute fractions 250*a*, 250*b*, 250*c*, 250*d*, 250*e* may be recovered by any chemically suitable technique at respective heteroatom-compound recoveries 601*a*, 601*b*, 601*c*, 601*d*, 601*e*. In some embodiments, the heteroatom-compound solute fractions 250*a*, 250*b*, 250*c*, 250*d*, 250*e* each may contain highly pure heteroatom compounds of a particular molecular structure. A solvent-recycle stream 225 may be directed to a solvent regenerator 230 for reintroduction into the fractionation vessel 220 through the HC solvent stream 235.

Figure 6:
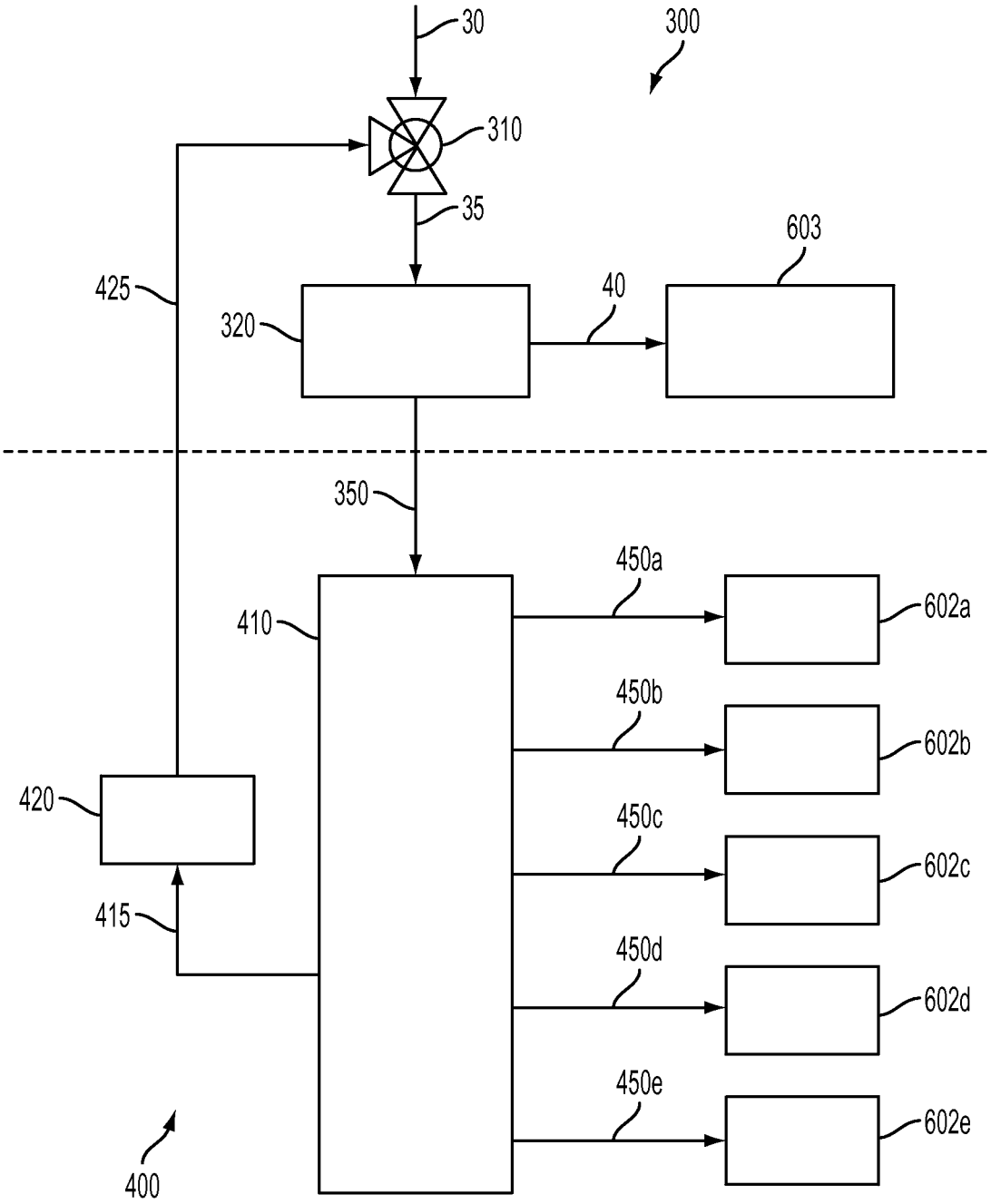
FIG. 6 is a schematic diagram of components of an exemplary extraction system according to FIG. 1 for separating or extracting polynuclear aromatic compounds from a heteroatom-lean stream in embodiments of methods for separating or extracting organic heteroatom compounds and polynuclear aromatic hydrocarbons from a hydrocarbon feedstock described herein.

Referring to FIGS. 1 and 6, the methods for recovering organic heteroatom compounds and PAHs from a hydrocarbon feedstock 10 may include transferring the heteroatom-compound lean stream 30 from the heteroatom-compound extraction system 100 or, more particularly, from an extraction vessel 120 of the heteroatom-compound extraction system 100, to a PAH extraction system 300 or, more particularly, to a PAH extractor 320 of a PAH extraction system 300. In some embodiments, the PAH extractor 320 is a vessel in which the heteroatom-compound lean stream 30 is combined with an second solvent system that extracts PAH compounds from the heteroatom-compound lean stream 30. The second solvent system may be mixed with the heteroatom-compound lean stream 30 in a three-way valve 310 in fluidic communication with a PAH solvent input 425, for example, to form a PAH extraction feed 35 that is introduced into the PAH extractor 320. The second solvent system may include at least one aprotic solvent chosen from aromatic solvents, N-methylpyrrolidone (NMP), dimethylsulfoxide (DMSO), or combinations thereof, for example. In some embodiments, the second solvent may further include a protic co-solvent such as water or acetic acid, for example.

In the PAH extractor 320, after sufficient residence time of about 3 minutes to about 2 hours, for example, phase separation of the components of the heteroatom-compound lean stream 30 occurs to result in a PAH-lean phase substantially devoid of PAHs and a PAH-rich phase of a mixture of PAH compounds in solvent. The PAH-lean phase may be transferred as a raffinate stream 40 to a raffinate recovery vessel 603 for additional processing such as hydrotreatment, for example. The PAH-rich phase may be transferred as a PAH recovery stream 350 to a PAH fractionator 400, which includes a PAH fractionation vessel 410. Thus, the PAH recovery stream 350 may be introduced into the PAH fractionation vessel 410, in which the PAH recovery stream 350 undergoes a separation process. In one embodiment, the separation process is dependent on boiling point variations of various PAH components in the PAH recovery stream 350. For example, the separation process may include fractional distillation. The separation process separates the PAH recovery stream 350, which includes a mixture of PAH compounds, into multiple PAH solute fractions 450*a*, 450*b*, 450*c*, 450*d*, 450*e*. The multiple PAH solute fractions 450*a*, 450*b*, 450*c*, 450*d*, 450*e* may be recovered by any chemically suitable technique at respective PAH-compound recoveries 602*a*, 602*b*, 602*c*, 602*d*, 602*e*. In some embodiments, the PAH solute fractions 450*a*, 450*b*, 450*c*, 450*d*, 450*e* each may contain highly pure PAH compounds of a particular molecular structure. A solvent-recycle stream 415 may be directed to a solvent regenerator 420 for reintroduction into the PAH extraction system 300 through the PAH solvent input 425, for example. In some embodiments, the PAH solute fractions 450*a*, 450*b*, 450*c*, 450*d*, 450*e* comprise, consist essentially of, or consist of 2-4 cycle PAHs or 3-4 cycle PAHs in any residual solvent.

Embodiments of methods for producing the hydrocarbon raffinate, and methods for separating or extracting organic heteroatom compounds and polynuclear aromatic hydrocarbons from a hydrocarbon feedstock, have been described. The methods in general may be described as "nonconventional refining" processes, because they selectively remove some of the tenacious heteroatom compounds and 2-4 cycle PAHs or 3-4 cycle PAHs from crude oil and crude fractions in consecutive separation processes to eliminate a wide array of problems during hydroprocessing of crude fractions when integrated with the conventional petroleum refining process. Additionally, the removal of 2-4 cycle PAHs or 3-4 cycle PAHs can also mitigate particulate emission problems from transportation fuels.

The heteroatom compounds and PAHs compounds extracted by the methods described above are present in heavier crude and are also considered nuisances during hydroprocessing operations. During hydroprocessing, the compounds contribute to deactivation of expensive catalysts and also require the processing to be conducted at higher temperatures and under higher pressures of hydrogen. Moreover, the unreacted leftover PAHs are precursors to particulate formation and contribute to pollution. In existing refinery configurations, the conversion of these heterocyclic molecules results in elemental sulfur, which is an environmental concern in terms cost and disposal. On the other hand, the removal of heteroatom compounds and PAHs compounds before hydroprocessing actually eliminates the need for high severity hydroprocessing and reduces the sulfur disposal cost, associated environmental pollutions and reduced capital investment.

The removal of heteroatom compounds and PAHs from crude fractions can improve the kinetics and cost of hydroprocessing operation in the refineries. Advantageously, the extracted compounds from crude fractions can be used as feedstock for fine chemicals, biochemicals, pharmaceuticals, and materials for organic solar cells, organic electronic materials, and photovoltaic solar energy storage. Thus, the extraction and recovery of these materials can potentially open new business lines as feedstocks for producing new generations of biochemical feedstocks, chemicals for organic semiconductors, optoelectronics devices, and organic solar cells, for example.

According to a first aspect, the present disclosure provides methods of producing a hydrocarbon raffinate having reduced levels of heteroatom compounds and 2-4 cycle polynuclear aromatic hydrocarbons. The methods may include providing a hydrocarbon feedstock containing crude oil fractions with a boiling point range of from about 165° C. to about 430° C., the crude oil fractions comprising heteroatom compounds and 2-4 cycle polynuclear aromatic hydrocarbons. The methods may include extracting at least a portion of the heteroatom compounds from the hydrocarbon feedstock with a tunable solvent in at least one extraction vessel of a heteroatom extraction system to form a heteroatom-compound rich stream containing heteroatom compounds and a heteroatom-compound lean stream containing the 2-4 cycle polynuclear aromatic hydrocarbons, the tunable solvent comprising an ionic liquid formed from pressurized carbon dioxide and water. The methods may include extracting the 2-4 cycle polynuclear aromatic hydrocarbons from the heteroatom-compound lean stream with a solvent system to form the hydrocarbon raffinate, the solvent system comprising an aprotic solvent.

According to a second aspect, the present disclosure provides methods according to the first aspect, in which extracting at least a portion of the heteroatom compounds from the hydrocarbon feedstock comprises extracting from the hydrocarbon feedstock a first portion of the heteroatom compounds having a first polarity to form a first feed stream, the first portion of the heteroatom compounds being extracted in a first extraction vessel of the heteroatom extraction system operating at a first pressure. The methods further include extracting from the first feed stream a second portion of the heteroatom compounds having a second polarity lower than the first polarity to form a second feed stream, the second portion of the heteroatom compounds being extracted in a second extraction vessel of the heteroatom extraction system operating at a second pressure higher than the first pressure after extracting the first portion of the heteroatom compounds. The methods further include extracting from the second feed stream a third portion of the heteroatom compounds having a third polarity lower than the second polarity to form the heteroatom-compound lean stream, the third portion of the heteroatom compounds being extracted in a third extraction vessel of the heteroatom extraction system operating at a third pressure greater than the first pressure and the second pressure after extracting the second portion of the heteroatom compounds.

According to a third aspect, the present disclosure provides methods according to the first or second aspect, in which at least 99% of the heteroatom compounds by weight from the hydrocarbon feedstock are extracted into the heteroatom-compound rich stream.

According to a fourth aspect, the present disclosure provides methods according to any one of the first through third aspects, in which the aprotic solvent is chosen from N-methylpyrrolidone, dimethylsulfoxide, and aromatic compounds.

According to a fifth aspect, the present disclosure provides methods according to any one of the first through fourth aspects, in which the aprotic solvent is chosen from N-methylpyrrolidone, dimethylsulfoxide, and aromatic compounds and the solvent system further comprises a protic co-solvent.

According to a sixth aspect, the present disclosure provides methods for extracting heteroatom compounds and 2-4 cycle polynuclear aromatic hydrocarbons from a hydrocarbon feedstock containing the heteroatom compounds and the 2-4 cycle polynuclear aromatic hydrocarbons are provided. The methods may include extracting at least one targeted portion of the heteroatom compounds from the hydrocarbon feedstock with an aqueous solvent comprising an ionic liquid formed from pressurized carbon dioxide and water. The methods may also include transferring to a PAH extractor a heteroatom-lean stream containing the 2-4 cycle polynuclear aromatic hydrocarbons after all targeted portions of the heteroatom compounds have been extracted from the hydrocarbon feedstock. The methods may also include extracting the 2-4 cycle polynuclear aromatic hydrocarbons from the heteroatom-lean stream in the PAH extractor with a solvent system comprising an aprotic solvent.

According to a seventh aspect, the present disclosure provides methods according to the sixth aspect, in which extracting at least one targeted portion of the heteroatom compounds from the hydrocarbon feedstock comprises: extracting a first targeted portion of the heteroatom compounds having a first polarity in a first extraction vessel operating at a first pressure; extracting a second targeted portion of the heteroatom compounds in a second extraction vessel after extracting the first portion, the second extraction vessel operating at a second pressure greater than the first pressure, the second portion of the heteroatom compounds having a second polarity that is lower than the first polarity; and extracting a third targeted portion of the heteroatom compounds in a third extraction vessel after extracting the second portion of the heteroatom compounds, the third extraction vessel operating at a third pressure greater than the first pressure and the second pressure, the third portion of the heteroatom compounds having a third polarity lower that is lower than the second polarity.

According to an eighth aspect, the present disclosure provides methods according to the sixth or seventh aspect, in which the extraction of each targeted portion of the heteroatom compounds from the hydrocarbon feedstock comprises feeding into an extraction vessel separately or as a mixture: the hydrocarbon feedstock or a feed stream derived from the hydrocarbon feedstock; and the aqueous solvent, whereby the combination of the hydrocarbon feedstock or the feed stream with the aqueous solvent in the extraction vessel forms an extraction mixture. The methods further comprise tuning the aqueous solvent to selectively form solvent complexes with the targeted portion of the heteroatom compounds in the extraction mixture, whereby the extraction mixture separates into at least a heteroatom-compound rich phase and a heteroatom-compound lean phase, the heteroatom-compound rich phase containing the solvent complexes; and removing the heteroatom-compound lean phase from the extraction vessel as a heteroatom-compound lean stream; removing the heteroatom-compound rich phase from the extraction vessel as a heteroatom-compound rich stream; and optionally transferring the heteroatom-compound lean stream from the extraction vessel as a feed stream derived from the hydrocarbon feedstock to an additional extraction vessel for extraction of an additional targeted portion of heteroatom compounds from the feed stream.

According to a ninth aspect, the present disclosure provides methods according to any one of the sixth through eighth aspects, in which tuning the aqueous solvent system comprises establishing an extraction pressure and an extraction temperature of the extraction mixture in the extraction vessel that together tune the aqueous solvent to selectively form a solvent complex with the targeted portion of the heteroatom compounds, wherein the extraction pressure is from 2 bar to 300 bar and the extraction temperature of the extraction mixture is from greater than the critical temperature of carbon dioxide to about 150° C.

According to a tenth aspect, the present disclosure provides methods according to any one of the sixth through ninth aspects, in which at least two targeted portions of the heteroatom compounds are removed from the hydrocarbon feedstock, and extracting each targeted portion of the heteroatom compounds from the hydrocarbon feedstock further comprises transferring the heteroatom-compound rich stream to a respective ejector vessel; depressurizing the respective ejector vessel to decrease the solubility of the heteroatom compounds in the aqueous solvent and eject a mixture of heteroatom compounds from the aqueous solvent; and separating the mixture of heteroatom compounds from the aqueous solvent to form a heteroatom-compound recovery stream.

According to a eleventh aspect, the present disclosure provides methods according to the tenth aspect, further comprising: transferring the heteroatom-compound recovery stream to a heteroatom-compound fractionator; fractionating the mixture of heteroatom compounds in the heteroatom-compound recovery stream in the fractionator into multiple heteroatom-compound solute fractions; and recovering heteroatom compounds from the heteroatom-compound solute fractions.

According to a twelfth aspect, the present disclosure provides methods according to any one of the sixth through eleventh aspects, in which extracting at least one targeted portion of the heteroatom compounds from the hydrocarbon feedstock comprises extracting one targeted portion of the heteroatom compounds from the hydrocarbon feedstock, the one targeted portion of the heteroatom compounds comprising greater than 90% by weight of the heteroatom compounds present in the hydrocarbon feedstock.

According to a thirteenth aspect, the present disclosure provides methods according to the twelfth aspect, further comprising extracting at least one targeted portion of the heteroatom compounds from a PAH-lean heteroatom-compound rich stream, wherein the PAH-lean heteroatom-compound rich stream is the heteroatom-compound rich stream formed during extraction of the one targeted portion of the heteroatom compounds from the hydrocarbon feedstock.

According to a fourteenth aspect, the present disclosure provides methods according to the twelfth or thirteenth aspects, in which the extraction of each targeted portion of the heteroatom compounds from the PAH-lean heteroatom-compound rich stream comprises feeding into an extraction vessel separately or as a mixture: the PAH-lean heteroatom-compound rich stream or a feed stream derived from the PAH-lean heteroatom-compound rich stream; and an aqueous solvent comprising an ionic liquid formed from pressurized carbon dioxide and water, whereby the combination of the hydrocarbon feedstock or the feed stream with the aqueous solvent forms an extraction mixture. The methods further comprise tuning the aqueous solvent to selectively form solvent complexes with the targeted portion of the heteroatom compounds in the extraction mixture, whereby the extraction mixture separates into at least a heteroatom-compound rich phase and a heteroatom-compound lean phase, the heteroatom-compound rich phase containing the solvent complexes; and removing the heteroatom-compound lean phase from the extraction vessel as a heteroatom-compound lean stream; removing the heteroatom-compound rich phase from the extraction vessel as a heteroatom-compound rich stream; and optionally transferring the heteroatom-compound lean stream from the extraction vessel as a feed stream derived from the PAH-lean heteroatom-compound rich stream to an additional extraction vessel for extraction of an additional targeted portion of heteroatom compounds from the feed stream.

According to a fifteenth aspect, the present disclosure provides methods according to any one of the twelfth through fourteenth aspects, in which extracting at least one targeted portion of the heteroatom compounds from the PAH-lean heteroatom-compound rich stream comprises extracting a first targeted portion of the heteroatom compounds having a first polarity in a first extraction vessel operating at a first pressure; extracting a second targeted portion of the heteroatom compounds in a second extraction vessel after extracting the first portion, the second extraction vessel operating at a second pressure greater than the first pressure, the second portion of the heteroatom compounds having a second polarity that is lower than the first polarity; and extracting a third targeted portion of the heteroatom compounds in a third extraction vessel after extracting the second portion of the heteroatom compounds, the third extraction vessel operating at a third pressure greater than the first pressure and the second pressure, the third portion of the heteroatom compounds having a third polarity lower that is lower than the first polarity.

According to a sixteenth aspect, the present disclosure provides methods according to any one of the thirteenth through fifteenth aspects, in which extracting each targeted portion of the heteroatom compounds from the PAH-lean heteroatom-compound rich stream further comprises transferring each heteroatom-compound rich phase to a respective ejector vessel; depressurizing the ejector vessel to decrease the solubility of the heteroatom compounds in the aqueous solvent and eject a mixture of heteroatom compounds from the aqueous solvent; and separating the mixture of heteroatom compounds from the aqueous solvent to form a heteroatom-compound recovery stream.

According to a seventeenth aspect, the present disclosure provides methods according to the sixteenth aspect, further comprising transferring the heteroatom-compound recovery stream to a heteroatom-compound fractionator; separating the mixture of heteroatom compounds in the heteroatom-compound recovery stream in the fractionator into multiple heteroatom-compound solute fractions; and recovering heteroatom compounds from the heteroatom-compound solute fractions.

According to an eighteenth aspect, the present disclosure provides methods according to any one of the sixth through seventeenth aspects, in which extracting the 2-4 cycle polynuclear aromatic hydrocarbons comprises combining the heteroatom-compound lean phase with the solvent system in the PAH extractor, whereby the heteroatom-compound lean phase separates into a PAH-rich phase and a PAH-lean phase, the PAH-rich phase comprising a mixture of polynuclear aromatic hydrocarbons. The methods further comprise removing the PAH-rich phase from the PAH extractor as a PAH recovery stream; and removing the PAH-lean phase from the PAH extractor as a lean raffinate.

According to a nineteenth aspect, the present disclosure provides methods according to the eighteenth aspect, further comprising transferring the PAH recovery stream to a PAH fractionator; separating the mixture of polynuclear aromatic hydrocarbons in the PAH recovery stream in the PAH fractionator into multiple PAH solute fractions; and recovering polynuclear aromatic hydrocarbons from the PAH solute fractions.

According to a twentieth aspect, the present disclosure provides methods according to any one of the sixth through nineteenth aspects, in which the heteroatom compounds comprise pyrrole, pyridine, quinoline, carbazole, indole, nickel tetraphenylporphyrin, vanadyl tetraphenylporphyrin, thiophene, benzothiophene, dibenzothiophene, 7,8,9,10-tetrahydro-benzo[b]naphtho[2,3-d]thiophene, or combinations thereof; and the 2-4 cycle polynuclear aromatic hydrocarbons comprise benzanthracenes, naphthalenes, anthracenes, pyrenes, phenanthrenes, tetracenes, or combinations thereof.

It should be apparent to those skilled in the art that various modifications and variations can be made to the embodiments described herein without departing from the spirit and scope of the claimed subject matter. Thus it is intended that the specification cover the modifications and variations of the various embodiments described herein provided such modification and variations come within the scope of the appended claims and their equivalents.

What is claimed is:

1. A method of producing a hydrocarbon raffinate having reduced levels of heteroatom compounds and 2-4 cycle polynuclear aromatic hydrocarbons, the method comprising:

providing a hydrocarbon feedstock containing crude oil fractions with a boiling point range of from about 165° C. to about 430° C., the crude oil fractions comprising heteroatom compounds and 2-4 cycle polynuclear aromatic hydrocarbons;

extracting at least a portion of the heteroatom compounds from the hydrocarbon feedstock with a tunable solvent in at least one extraction vessel of a heteroatom extraction system to form at least one heteroatom-compound rich stream containing heteroatom compounds and a heteroatom-compound lean stream containing the 2-4 cycle polynuclear aromatic hydrocarbons, the tunable solvent comprising an ionic liquid formed from pressurized carbon dioxide and water, wherein extracting at least a portion of the heteroatom compounds from the hydrocarbon feedstock comprises:

extracting from the hydrocarbon feedstock a first portion of the heteroatom compounds having a first polarity to form a first heteroatom compound rich stream and a first heteroatom compound lean stream, the first portion of the heteroatom compounds being extracted in a first extraction vessel of the heteroatom extraction system operating at a first pressure, the first heteroatom compound rich stream containing the tunable solvent;

extracting from the first heteroatom compound lean stream a second portion of the heteroatom compounds having a second polarity lower than the first polarity to form a second heteroatom compound rich stream and a second heteroatom compound lean stream, the second portion of the heteroatom compounds being extracted in a second extraction vessel of the heteroatom extraction system operating at a second pressure higher than the first pressure after extracting the first portion of the heteroatom compounds, the second heteroatom compound rich stream containing the tunable solvent; and extracting from the second heteroatom compound lean stream a third portion of the heteroatom compounds having a third polarity lower than the second polarity to form the heteroatom-compound lean stream and a third heteroatom compound rich stream, the third portion of the heteroatom compounds being extracted in a third extraction vessel of the heteroatom extraction system operating at a third pressure greater than the second pressure after extracting the second portion of the heteroatom compounds, the third heteroatom compound rich stream containing the tunable solvent; and extracting the 2-4 cycle polynuclear aromatic hydrocarbons from the heteroatom-compound lean stream with a solvent system to form the hydrocarbon raffinate, the solvent system comprising an aprotic solvent.

2. The method of claim 1, wherein at least 99% of the heteroatom compounds by weight from the hydrocarbon feedstock are extracted into the heteroatom-compound rich streams.

3. The method of claim 1, wherein the aprotic solvent is chosen from N-methylpyrrolidone, dimethylsulfoxide, and aromatic compounds.

4. The method of claim 1, wherein the aprotic solvent is chosen from N-methylpyrrolidone, dimethylsulfoxide, and aromatic compounds and the solvent system further comprises a protic co-solvent.

5. A method for extracting heteroatom compounds and 2-4 cycle polynuclear aromatic hydrocarbons from a hydrocarbon feedstock containing the heteroatom compounds and the 2-4 cycle polynuclear aromatic hydrocarbons, the method comprising:

extracting at least one targeted portion of the heteroatom compounds from the hydrocarbon feedstock with an aqueous solvent comprising an ionic liquid formed from pressurized carbon dioxide and water, wherein the temperature of the aqueous solvent is from greater than the critical temperature of carbon dioxide to about 150° C., wherein the extraction of each targeted portion of the heteroatom compounds from the hydrocarbon feedstock comprises:

feeding into an extraction vessel separately or as a mixture:

the hydrocarbon feedstock or a feed stream derived from the hydrocarbon feedstock; and the aqueous solvent, whereby the combination of the hydrocarbon feedstock or the feed stream with the aqueous solvent in the extraction vessel forms an extraction mixture;

tuning the aqueous solvent to selectively form solvent complexes with the targeted portion of the heteroatom compounds in the extraction mixture, whereby the extraction mixture separates into at least a heteroatom-compound rich phase and a heteroatom-compound lean phase, the heteroatom-compound rich phase containing the aqueous solvent;

removing the heteroatom-compound lean phase from the extraction vessel as a heteroatom-compound lean stream;

removing the heteroatom-compound rich phase from the extraction vessel as a heteroatom-compound rich stream; and optionally transferring the heteroatom-compound lean stream from the extraction vessel as a feed stream derived from the hydrocarbon feedstock to an additional extraction vessel for extraction of an additional targeted portion of heteroatom compounds from the feed stream;

transferring to a PAH extractor the heteroatom-compound lean stream containing the 2-4 cycle polynuclear aromatic hydrocarbons after all targeted portions of the heteroatom compounds have been extracted from the hydrocarbon feedstock; and extracting the 2-4 cycle polynuclear aromatic hydrocarbons from the the heteroatom-compound lean stream in the PAH extractor with a solvent system comprising an aprotic solvent.

6. The method of claim 5, wherein extracting at least one targeted portion of the heteroatom compounds from the hydrocarbon feedstock comprises:

extracting a first targeted portion of the heteroatom compounds having a first polarity in a first extraction vessel operating at a first pressure;

extracting a second targeted portion of the heteroatom compounds in a second extraction vessel after extracting the first portion, the second extraction vessel operating at a second pressure greater than the first pressure, the second portion of the heteroatom compounds having a second polarity that is lower than the first polarity; and extracting a third targeted portion of the heteroatom compounds in a third extraction vessel after extracting the second portion of the heteroatom compounds, the third extraction vessel operating at a third pressure greater than the second pressure, the third portion of the heteroatom compounds having a third polarity lower that is lower than the second polarity.

7. The method of claim 5, wherein tuning the aqueous solvent system comprises:

establishing an extraction pressure and an extraction temperature of the extraction mixture in the extraction vessel that together tune the aqueous solvent to selectively form a solvent complex with the targeted portion of the heteroatom compounds, wherein the extraction pressure is from 2 bar to 300 bar and the extraction temperature of the extraction mixture is from greater than the critical temperature of carbon dioxide to about 150° C.

8. The method of claim 5, wherein at least two targeted portions of the heteroatom compounds are removed from the hydrocarbon feedstock, and extracting each targeted portion of the heteroatom compounds from the hydrocarbon feedstock further comprises:

transferring the heteroatom-compound rich stream to a respective ejector vessel;

depressurizing the respective ejector vessel to decrease the solubility of the heteroatom compounds in the aqueous solvent and eject a mixture of heteroatom compounds from the aqueous solvent; and separating the mixture of heteroatom compounds from the aqueous solvent to form a heteroatom-compound recovery stream.

9. The method of claim 8, further comprising:

transferring the heteroatom-compound recovery stream to a heteroatom-compound fractionator;

fractionating the mixture of heteroatom compounds in the heteroatom-compound recovery stream in the fractionator into multiple heteroatom-compound solute fractions; and recovering heteroatom compounds from the heteroatom-compound solute fractions.

10. The method of claim 5, wherein:

extracting at least one targeted portion of the heteroatom compounds from the hydrocarbon feedstock comprises extracting one targeted portion of the heteroatom compounds from the hydrocarbon feedstock, the one targeted portion of the heteroatom compounds comprising greater than 90% by weight of the heteroatom compounds present in the hydrocarbon feedstock.

11. The method of claim 10, further comprising:

extracting at least one targeted portion of the heteroatom compounds from a PAH-lean heteroatom-compound rich stream, wherein the PAH-lean heteroatom-compound rich stream is the heteroatom-compound rich stream formed during extraction of the one targeted portion of the heteroatom compounds from the hydrocarbon feedstock.

12. The method of claim 11, wherein extracting at least one targeted portion of the heteroatom compounds from the PAH-lean heteroatom-compound rich stream comprises:

extracting a first targeted portion of the heteroatom compounds having a first polarity in a first extraction vessel operating at a first pressure;

extracting a second targeted portion of the heteroatom compounds in a second extraction vessel after extracting the first portion, the second extraction vessel operating at a second pressure greater than the first pressure, the second portion of the heteroatom compounds having a second polarity that is lower than the first polarity; and extracting a third targeted portion of the heteroatom compounds in a third extraction vessel after extracting the second portion of the heteroatom compounds, the third extraction vessel operating at a third pressure greater than the first pressure and the second pressure, the third portion of the heteroatom compounds having a third polarity lower that is lower than the first polarity.

13. The method of claim 11, wherein extracting each targeted portion of the heteroatom compounds from the PAH-lean heteroatom-compound rich stream further comprises:

transferring each heteroatom-compound rich phase to a respective ejector vessel;

depressurizing the ejector vessel to decrease the solubility of the heteroatom compounds in the aqueous solvent and eject a mixture of heteroatom compounds from the aqueous solvent; and separating the mixture of heteroatom compounds from the aqueous solvent to form a heteroatom-compound recovery stream.

14. The method of claim 13, further comprising:

transferring the heteroatom-compound recovery stream to a heteroatom-compound fractionator;

separating the mixture of heteroatom compounds in the heteroatom-compound recovery stream in the fractionator into multiple heteroatom-compound solute fractions; and recovering heteroatom compounds from the heteroatom-compound solute fractions.

15. The method of claim 5, wherein extracting the 2-4 cycle polynuclear aromatic hydrocarbons comprises:

combining the heteroatom-compound lean phase with the solvent system in the PAH extractor, whereby the heteroatom-compound lean phase separates into a PAH-rich phase and a PAH-lean phase, the PAH-rich phase comprising a mixture of polynuclear aromatic hydrocarbons;

removing the PAH-rich phase from the PAH extractor as a PAH recovery stream; and removing the PAH-lean phase from the PAH extractor as a lean raffinate.

16. The method of claim 15, further comprising:

transferring the PAH recovery stream to a PAH fractionator;

separating the mixture of polynuclear aromatic hydrocarbons in the PAH recovery stream in the PAH fractionator into multiple PAH solute fractions; and recovering polynuclear aromatic hydrocarbons from the PAH solute fractions.

17. The method of claim 5, wherein:

the heteroatom compounds comprise pyrrole, pyridine, quinoline, carbazole, indole, nickel tetraphenylporphyrin, vanadyl tetraphenylporphyrin, thiophene, benzothiophene, dibenzothiophene, 7,8,9,10-tetrahydro-benzo[b]naphtho[2,3-d]thiophene, or combinations thereof; and the 2-4 cycle polynuclear aromatic hydrocarbons comprise benzanthracenes, naphthalenes, anthracenes, pyrenes, phenanthrenes, tetracenes, or combinations thereof.

* * * * *